US008808950B2

(12) United States Patent
Fujisawa et al.

(10) Patent No.: US 8,808,950 B2
(45) Date of Patent: Aug. 19, 2014

(54) ELECTROPHOTOGRAPHIC PHOTORECEPTOR, METHOD FOR MANUFACTURING THE SAME, AND ELECTROPHOTOGRAPHIC PHOTORECEPTOR UNIT, REPLACEABLE IMAGE-FORMING UNIT, AND IMAGE-FORMING APPARATUS INCLUDING THE SAME

(75) Inventors: Yuichi Fujisawa, Kanagawa (JP); Masami Tanase, Kanagawa (JP); Keiichi Aoyagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 17 days.

(21) Appl. No.: 13/474,279

(22) Filed: May 17, 2012

(65) Prior Publication Data

US 2013/0137019 A1 May 30, 2013

(30) Foreign Application Priority Data

Nov. 30, 2011 (JP) ..... 2011-261728

(51) Int. Cl.
*G03G 15/00* (2006.01)

(52) U.S. Cl.
USPC ..... 430/56; 430/66; 399/159

(58) Field of Classification Search
CPC ..... B25B 21/004; B25B 21/02; B25B 37/00; B25B 37/02; G03G 5/147; G03G 15/00; G03G 15/751; G03G 21/00; G03G 21/0011; G03G 21/18
USPC ..... 430/56, 66; 399/159
See application file for complete search history.

(56) References Cited

U.S. PATENT DOCUMENTS

| | | | | |
|---|---|---|---|---|
| 5,418,349 | A * | 5/1995 | Swain et al. | 219/121.84 |
| 7,449,272 | B2 * | 11/2008 | Kawasaki et al. | 430/66 |
| 2003/0035668 | A1 * | 2/2003 | Endo et al. | 399/350 |
| 2011/0070537 | A1 * | 3/2011 | Sumitani et al. | 430/56 |
| 2012/0196213 | A1 * | 8/2012 | Aoyagi et al. | 430/56 |

FOREIGN PATENT DOCUMENTS

JP 2010-91934 A 4/2010

* cited by examiner

*Primary Examiner* — Mark F Huff
*Assistant Examiner* — Omar Kekia
(74) *Attorney, Agent, or Firm* — Sughrue Mion, PLLC

(57) ABSTRACT

An electrophotographic photoreceptor includes a substantially cylindrical support and a coating disposed on the support and including a photosensitive layer. The coating has lines due to polishing extending in a direction crossing a circumferential direction of a surface of the photoreceptor in at least part of a region outside an effective region available for image formation in an axial direction.

4 Claims, 17 Drawing Sheets

| | | UNPOLISHED | EXAMPLE 1 | EXAMPLE 2 | EXAMPLE 3 | MANUALLY POLISHED |
|---|---|---|---|---|---|---|
| AXIAL DIRECTION | | PROFILE CURVE (μm)  | PROFILE CURVE (μm)  | PROFILE CURVE (μm)  | PROFILE CURVE (μm)  | PROFILE CURVE (μm)  |
| | Ra | 0.0054 | 0.0106 | 0.0124 | 0.0077 | 0.0053 |
| | Rmax | 0.067 | 0.108 | 0.158 | 0.110 | 0.058 |
| CIRCUMFERENTIAL DIRECTION | | PROFILE CURVE (μm)  | PROFILE CURVE (μm)  | PROFILE CURVE (μm)  | PROFILE CURVE (μm)  | PROFILE CURVE (μm)  |
| | Ra | 0.0053 | 0.0054 | 0.0065 | 0.0056 | 0.0130 |
| | Rmax | 0.059 | 0.051 | 0.103 | 0.060 | 0.240 |

| | | UNPOLISHED | EXAMPLE 1 | EXAMPLE 2 | EXAMPLE 3 | MANUALLY POLISHED |
|---|---|---|---|---|---|---|
| AXIAL DIRECTION | | PROFILE CURVE (μm)  | PROFILE CURVE (μm)  | PROFILE CURVE (μm)  | PROFILE CURVE (μm)  | PROFILE CURVE (μm)  |
| | Ra | 0.0082 | 0.0088 | 0.0116 | 0.0080 | 0.0099 |
| | Rmax | 0.145 | 0.096 | 0.099 | 0.075 | 0.090 |
| CIRCUMFERENTIAL DIRECTION | | PROFILE CURVE (μm)  | PROFILE CURVE (μm)  | PROFILE CURVE (μm)  | PROFILE CURVE (μm)  | PROFILE CURVE (μm)  |
| | Ra | 0.0052 | 0.0054 | 0.0053 | 0.0061 | 0.0120 |
| | Rmax | 0.064 | 0.052 | 0.053 | 0.060 | 0.101 |

ELECTROPHOTOGRAPHIC PHOTORECEPTOR, METHOD FOR MANUFACTURING THE SAME, AND ELECTROPHOTOGRAPHIC PHOTORECEPTOR UNIT, REPLACEABLE IMAGE-FORMING UNIT, AND IMAGE-FORMING APPARATUS INCLUDING THE SAME

CROSS-REFERENCE TO RELATED APPLICATIONS

This application is based on and claims priority under 35 USC 119 from Japanese Patent Application No. 2011-261728 filed Nov. 30, 2011.

BACKGROUND (i) Technical Field

The present invention relates to electrophotographic photoreceptors, methods for manufacturing electrophotographic photoreceptors, and electrophotographic photoreceptor units, replaceable image-forming units, and image-forming apparatuses including electrophotographic photoreceptors.

(ii) Related Art

Some related-art cylindrical electrophotographic photoreceptors for use with electrophotographic image-forming apparatuses have the surfaces thereof intentionally roughened during manufacture. An as-manufactured photoreceptor has a nearly specular surface, which might cause a problem such as wear of a cleaning blade (flat cleaning member) that contacts and cleans the surface of the photoreceptor in a cleaning step due to the excessive coefficient of friction therebetween. This problem is addressed by intentionally roughening the surface of the photoreceptor during manufacture.

SUMMARY

According to an aspect of the invention, there is provided an electrophotographic photoreceptor including a substantially cylindrical support and a coating disposed on the support and including a photosensitive layer. The coating has lines due to polishing extending in a direction crossing a circumferential direction of a surface of the photoreceptor in at least part of a region outside an effective region available for image formation in an axial direction.

BRIEF DESCRIPTION OF THE DRAWINGS

Exemplary embodiments of the present invention will be described in detail based on the following figures, wherein:

FIG. 8A illustrates the state immediately after the polishing members are put into contact, and FIG. 8B illustrates the state where polishing is complete after moving the polishing members (or where polishing is underway);

FIG. 9A illustrates the state immediately after the polishing members are put into contact, and FIG. 9B illustrates the state where polishing is complete after moving the polishing members (or where polishing is underway);

FIG. 10A illustrates the state immediately after the polishing members are put into contact, and FIG. 10B illustrates the state where polishing is complete after moving the polishing members (or where polishing is underway);

FIG. 19A illustrates a polished photoreceptor drum and a cleaning blade abutting the drum, and FIG. 19B illustrates the leading end of the cleaning blade used on the polished photoreceptor drum in FIG. 19A.

DETAILED DESCRIPTION

Exemplary embodiments of the present invention will now be described with reference to the drawings.

First Exemplary Embodiment

Figure 1:
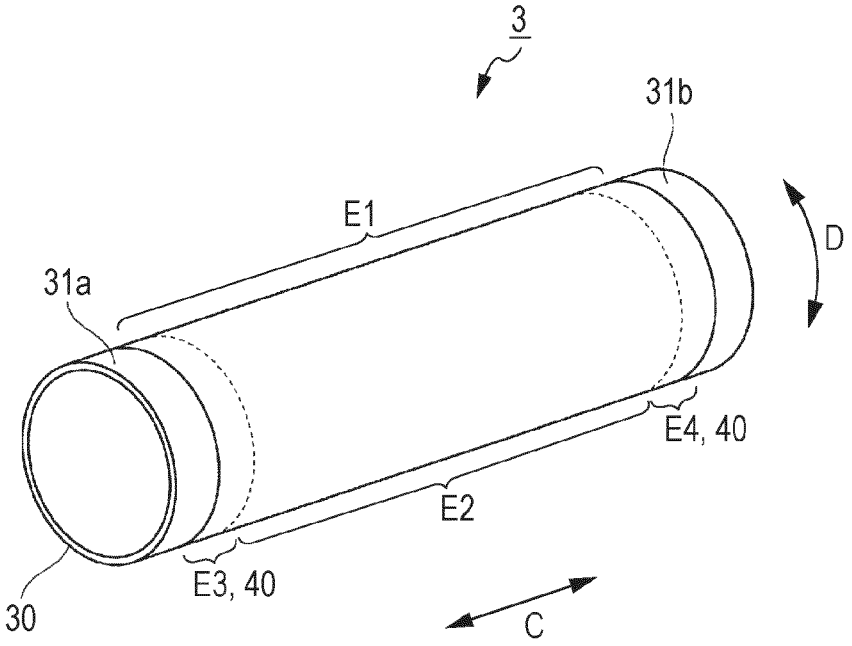
FIG. 1 is a schematic perspective view of an electrophotographic photoreceptor drum according to a first exemplary embodiment.
Figure 2:
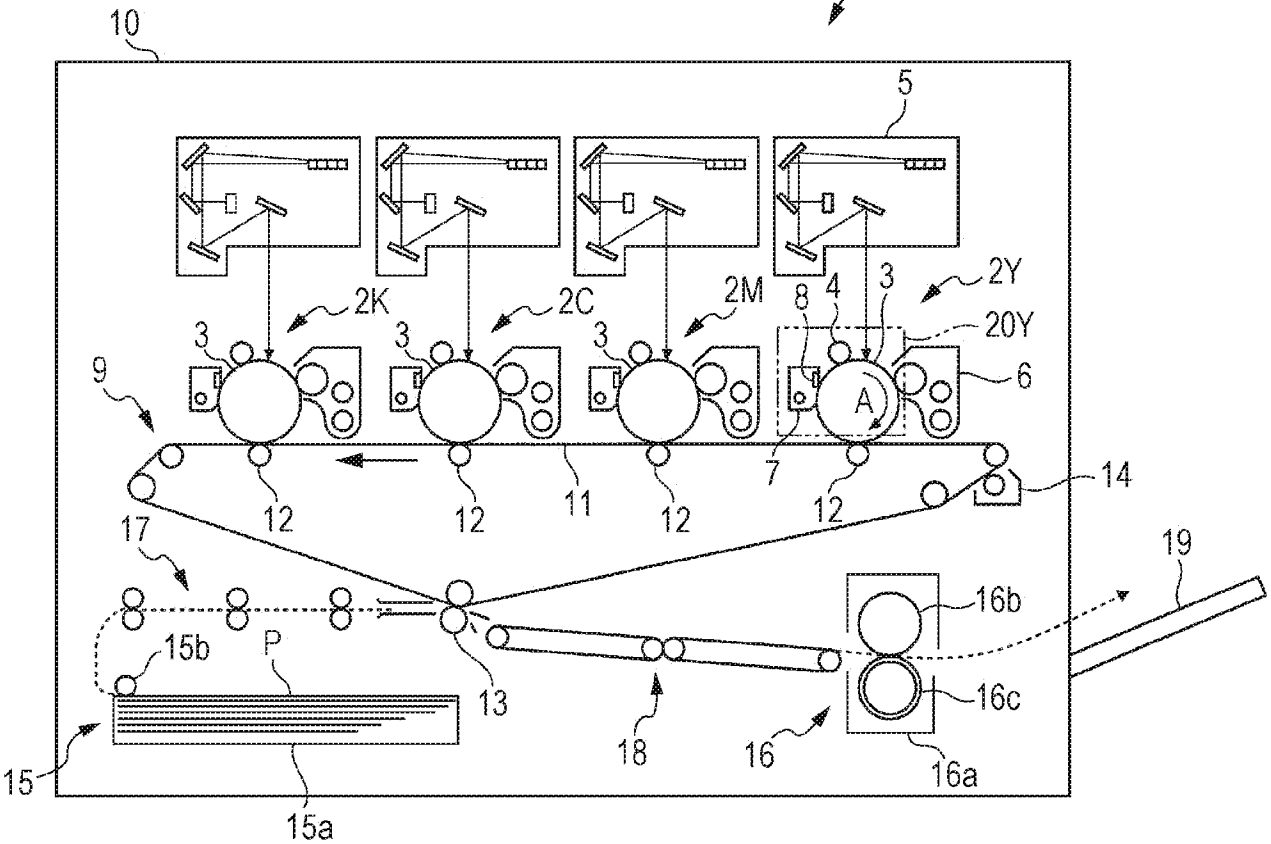
FIG. 2 is a schematic view of an image-forming apparatus including photoreceptor drums, each being the photoreceptor drum shown in FIG. 1.
Figure 3:
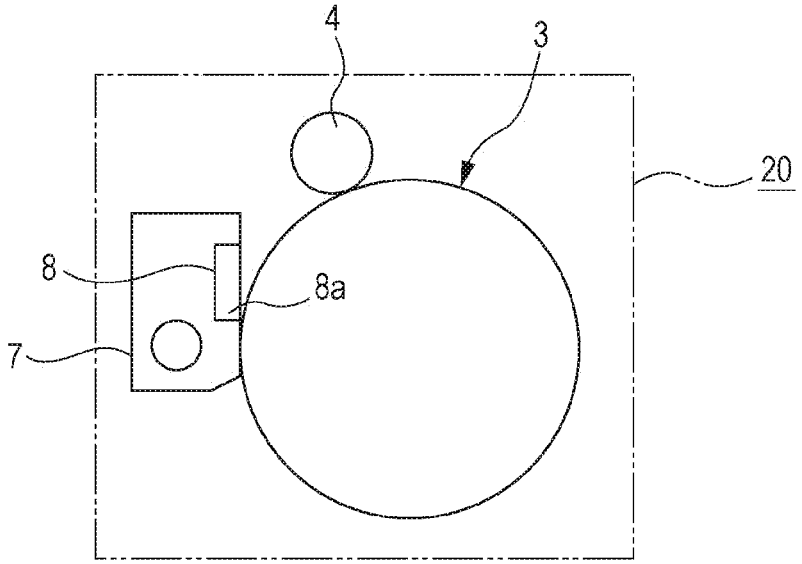
FIG. 3 is a schematic view of a process cartridge including the photoreceptor drum shown in FIG. 1.

FIGS. 1 to 3 illustrate a first exemplary embodiment. FIG. 1 illustrates an electrophotographic photoreceptor according to the first exemplary embodiment. FIG. 2 illustrates an image-forming apparatus including electrophotographic photoreceptors, each being the photoreceptor shown in FIG. 1. FIG. 3 illustrates a replaceable image-forming unit including the photoreceptor shown in FIG. 1.

Referring to FIG. 2, an image-forming apparatus 1 includes a body (housing) 10 in which image-forming sections 2Y, 2M, 2C, and 2K (collectively referred to as 2) corresponding to yellow (Y), magenta (M), cyan (C), and black (K), respectively, are arranged in parallel at a predetermined spacing in the horizontal direction. The image-forming sections 2Y, 2M, 2C, and 2K are electrophotographic image-forming sections that are identical except for the color of the developer (toner) used.

As a representative example, the yellow (Y) image-forming section 2Y will be described using reference signs. The image-forming section 2Y includes a cylindrical or substantially cylindrical photoreceptor drum 3, as an electrophotographic photoreceptor, a contact or non-contact charging device 4, an exposure device 5, as a latent-image forming unit, a one-component or two-component developing device 6, and a cleaning device 7. The photoreceptor drum 3 is driven at a predetermined rotational speed in the direction of arrow A. The charging device 4 charges the surface of the photoreceptor drum 3 to a predetermined potential. The exposure device 5 exposes the surface of the photoreceptor drum 3 to form an electrostatic latent image for the corresponding color. The developing device 6 develops the electrostatic latent image formed on the photoreceptor drum 3 with a developer (in practice, a toner) of the corresponding color to form a toner image. The cleaning device 7 cleans the surface of the photoreceptor drum 3.

As illustrated in FIGS. 2 and 3, the cleaning device 7 includes, for example, a flat cleaning blade (flat cleaning member) 8 formed of a material such as urethane rubber. The cleaning blade 8, functioning as a doctor blade, has the base end thereof located downstream in the rotational direction of the photoreceptor drum 3 and the leading end thereof (in practice, an edge 8*a*) abutting the surface of the photoreceptor drum 3 in the direction opposite to the rotational direction of the photoreceptor drum 3. The cleaning device 7 scrapes an undesired deposit, such as residual toner and external additive thereof, off the surface of the photoreceptor drum 3 at the leading end of the cleaning blade 8.

The image-forming apparatus 1 further includes an intermediate transfer section 9 disposed below the four image-forming sections 2Y, 2M, 2C, and 2K in the body 10. The intermediate transfer section 9 includes an intermediate transfer belt 11, first transfer devices 12, a second transfer device 13, and a belt-cleaning device 14. The intermediate transfer belt 11 rotates in contact with and passes through the transfer positions of the photoreceptor drums 3 of the image-forming sections 2Y, 2M, 2C, and 2K. The first transfer devices 12 transfer toner images from the photoreceptor drums 3 to the intermediate transfer belt 11. The second transfer device 13 transfers the toner images from the intermediate transfer belt 11 to recording paper P. The belt-cleaning device 14 cleans the outer circumferential surface of the intermediate transfer belt 11 after the second transfer. The intermediate transfer belt 11 is supported by rollers so as to rotate in a predetermined direction.

The image-forming apparatus 1 further includes a sheet feeding device 15 and a fixing device 16 that are disposed in the body 10. The sheet feeding device 15 holds recording paper P of predetermined size and type as a recording medium and feeds it to the second transfer position sheet by sheet. The fixing device 16 fixes an unfixed toner image transferred to the recording paper P.

The sheet feeding device 15 includes a sheet container 15*a* holding the recording paper P and a sheet feeder 15*b* that feeds the recording paper P from the sheet container 15*a* sheet by sheet. A sheet transport path 17 is formed between the sheet feeding device 15 and the second transfer position by components such as pairs of sheet transport rollers and a sheet guide member. The fixing device 16 includes a housing 16*a* containing a rotatable heating member 16*b* and a rotatable pressing member 16*c*. The heating member 16*b* is, for example, a roller or belt that rotates with the surface thereof heated to and maintained at a predetermined temperature by a heater. The pressing member 16*c* is, for example, a roller or belt that is rotated in contact with the heating member 16*b* substantially along the axis thereof at a predetermined pressure. The fixing device 16 fixes the toner image to the recording paper P as it passes through a fixing position between the heating member 16*b* and the pressing member 16*c*. A belt transport device 18 is disposed between the second transfer position and the fixing device 16 to transport the recording paper P after the second transfer to the fixing device 16.

The image-forming operation of the image-forming apparatus 1 will be outlined below.

When the image-forming apparatus 1 receives an instruction for image-forming operation, the surfaces of the photoreceptor drums 3 of the image-forming sections 2Y, 2M, 2C, and 2K are charged to a predetermined potential by the charging devices 4 and are exposed by the exposure devices 5 to form electrostatic latent images for the corresponding colors. The electrostatic latent images formed on the surfaces of the photoreceptor drums 3 are then subjected to reversal development or normal development by the corresponding developing devices 6 to form yellow, magenta, cyan, and black toner images on the surfaces of the respective photoreceptor drums 3.

The toner images are transferred from the surfaces of the photoreceptor drums 3 of the image-forming sections 2Y, 2M, 2C, and 2K to the intermediate transfer belt 11 by the first transfer devices 12 of the intermediate transfer section 9 such that they are superimposed on each other. The toner images are then simultaneously transferred by the second transfer device 13 to the recording paper P fed from the paper feeding device 15 to the second transfer position at a predetermined timing. The toner images of the individual colors are fixed to the recording paper P by the fixing device 16. Finally, the recording paper P is ejected onto a paper output tray 19 disposed outside the body 10 of the image-forming apparatus 1. In this way, a full-color or monochrome toner image is formed on the recording paper P.

After the first transfer step is complete, the cleaning blades 8 of the cleaning devices 7 in the image-forming sections 2 clean off a deposit such as residual toner and external additive thereof from the surfaces of the photoreceptor drums 3 to prepare for the next image-forming process. After the second transfer step is complete, the belt-cleaning device 14 in the intermediate transfer section 9 cleans off a deposit such as residual toner and external additive thereof from the surface of the intermediate transfer belt 11 to prepare for the next image-forming process.

In the image-forming apparatus 1, as illustrated in FIGS. 2 and 3, the photoreceptor drums 3, the charging devices 4, and the cleaning devices 7 in the image-forming sections 2Y, 2M, 2C, and 2K are assembled into process cartridges 20Y, 20M, 20C, and 20K (collectively referred to as 20) as replaceable image-forming units for ease of maintenance. Each process cartridge 20 is mounted on the image-forming apparatus 1 such that the photoreceptor drum 3, the charging device 4, and the cleaning device 7 are integrally attached to a support frame (not shown). Each process cartridge 20, when used, is detachably mounted at mounting positions in the body 10 of the image-forming apparatus 1 with a guide rail and a securing member (not shown) therebetween.

Because the image-forming apparatus 1 uses the process cartridges 20, the user can easily replace any process cartridge 20 with a new process cartridge when, for example, the photoreceptor drum 3 is no longer serviceable, which facilitates maintenance of the image-forming apparatus 1.

Next, the photoreceptor drums 3 used for the image-forming apparatus 1 and the process cartridges 20 will be described in detail.

Referring to FIG. 1, the photoreceptor drum 3 is an electrophotographic photoreceptor having a cylindrical or substantially cylindrical body. The photoreceptor drum 3 is manufactured by finally polishing particular regions of the surface of an electrophotographic photoreceptor drum substrate 30 having the layered structure illustrated in FIG. 4A or the layered structure illustrated in FIG. 4B, as described later.

The electrophotographic photoreceptor drum substrate 30 will be described first. As schematically illustrated in an enlarged view in FIG. 4A, the photoreceptor drum substrate 30 includes a cylindrical or substantially cylindrical conductive support 31 and a coating 32 formed on the surface (outer circumferential surface) of the support 31. The coating 32 includes an undercoat layer 33 and a photosensitive layer 34. The photosensitive layer 34 is typically of function-separated type, including a charge generating layer 341 that generates charge when exposed to light and a charge transport layer 342 that transports the charge generated by the charge generating layer 341. As schematically illustrated in an enlarged view in FIG. 4B, the coating 32 may further include a surface protective layer 35 formed on the photosensitive layer 34.

The photoreceptor drum substrate 30 is manufactured through the following steps.

Step of Fabricating Conductive Support

The conductive support 31 is typically selected from supports used for photoreceptor drums in the related art. Examples of supports include cylindrical supports formed of metals such as aluminum, nickel, chromium, and stainless steel and cylindrical insulating supports coated with conductive materials or having conductive materials deposited thereon.

The conductive support 31 is formed in a cylindrical shape with a predetermined outer diameter. For example, the support 31 may be a cylinder, such as a pipe, formed of a metal as listed above. If the support 31 is a metal cylinder, it may be used as-manufactured or may be subjected to surface treatment such as mirror grinding, etching, anodizing, rough cutting, centerless grinding, sand blasting, or wet honing.

Step of Forming Coating

In the next step, the coating 32 including at least the photosensitive layer 34 is formed on the surface of the conductive support 31.

Figure 4A:
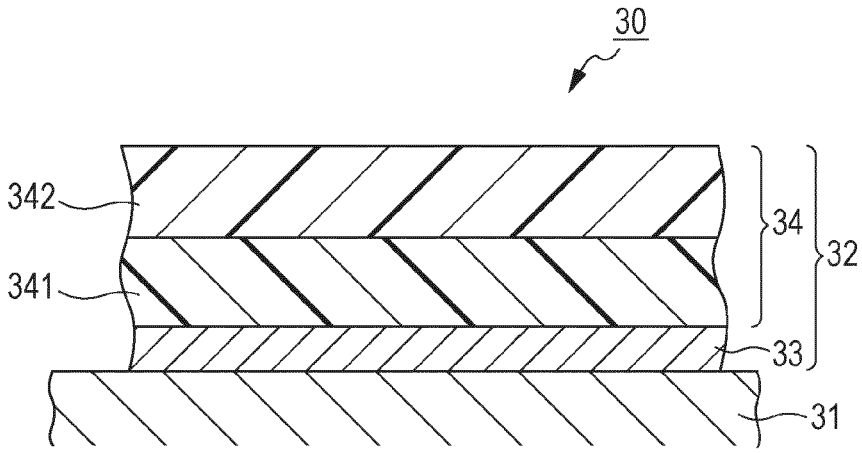
FIGS. 4A and 4B are schematic sectional views illustrating examples of the layer structure of the photoreceptor drum (substrate) shown in FIG. 1.
Figure 4B:
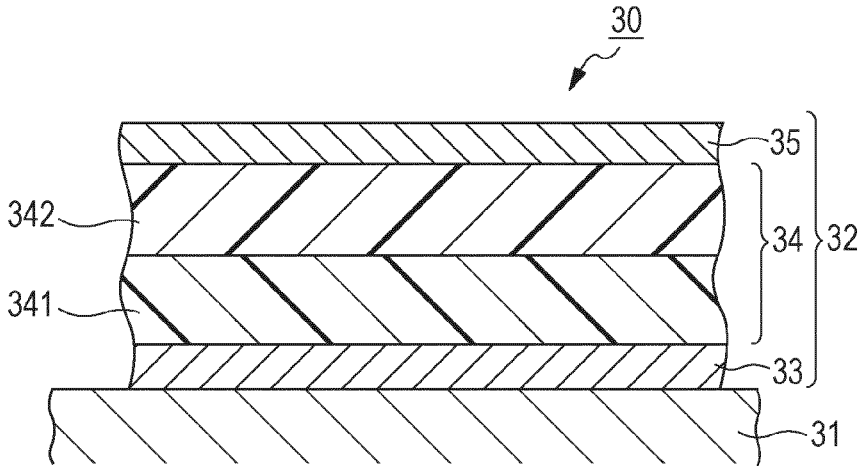

The formation of the coating 32 including the photosensitive layer 34, as illustrated in FIGS. 4A and 4B, begins with forming the undercoat layer 33 on the surface of the conductive support 31. The undercoat layer 33 is provided, for example, to prevent light reflection and scattering on the surface of the conductive support 31 and to block an undesired flow of carriers (countercharge) from the conductive support 31 into the photosensitive layer 34 as the surface of the photosensitive layer 34 is charged.

The undercoat layer 33 is formed by, for example, dispersing a metal powder such as aluminum, copper, nickel, or silver powder, a conductive metal oxide such as antimony oxide, indium oxide, tin oxide, or zinc oxide, or a conductive material such as carbon fiber, carbon black, or graphite powder in a binder resin and applying the dispersion to the surface of the conductive support 31. The coating 32, including the undercoat layer 33, is formed on the surface of the conductive support 31 excluding both ends 31*a* and 31*b* in the axial direction C (see, for example, FIGS. 1 and 5). The undercoat layer 33 does not necessarily have to be formed in the step of forming the coating 32, but may instead be formed in the step of fabricating the conductive support 31 described above. Although not shown, an intermediate layer may be formed on the undercoat layer 33 for purposes such as improved electrical properties, improved image quality, improved image durability, and improved adhesion of the photosensitive layer 34.

The photosensitive layer 34 is then formed on the undercoat layer 33 on the conductive support 31. As described above, the photosensitive layer 34 is illustrated as the function-separated type.

The charge generating layer 341 of the photosensitive layer 34 is formed from a composition containing a charge generating material and a suitable binder resin. Examples of charge generating materials include phthalocyanine pigments such as metal-free phthalocyanine, chlorogallium phthalocyanine, hydroxygallium phthalocyanine, dichlorotin phthalocyanine, and titanyl phthalocyanine. These charge generating materials may be used alone or as a mixture of two or more thereof.

Examples of binder resins used for the charge generating layer 341 include polycarbonate resins such as bisphenol A and Z polycarbonate resins, acrylic resins, methacrylic resins, polyarylate resins, polyester resins, polyvinyl chloride resins, polystyrene resins, acrylonitrile-styrene copolymers, acrylonitrile-butadiene copolymers, polyvinyl acetate resins, polyvinyl formal resins, polysulfone resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, phenol-formaldehyde resins, polyacrylamide resins, polyamide resins, and poly-N-vinylcarbazole resins. These binder resins may be used alone or as a mixture of two or more thereof.

The charge generating layer 341 is formed by applying a coating solution containing the above materials to the undercoat layer 33. Examples of coating processes include dip coating, lift coating, wire bar coating, spray coating, blade coating, ring coating, knife coating, and curtain coating. The charge generating layer 341 has a thickness of, for example, 0.01 to 5 μm.

As illustrated in FIG. 4A, the charge transport layer 342 of the photosensitive layer 34 forms the outermost layer on the electrophotographic photoreceptor 3 according to the first exemplary embodiment. The charge transport layer 342 is formed from a composition containing a charge transport material and a suitable binder resin.

Examples of charge transport materials include oxadiazoles such as 2,5-bis(p-diethylaminophenyl)-1,3,4-oxadiazole; pyrazolines such as 1,3,5-triphenylpyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triadines such as 3-(4'-dimethylaminophenyl)-5,6-di(4'-methoxyphenyl)-1,2,4-triadine; hydrazones such as 4-dimethylaminobenzaldehyde-1,1-diphenylhydrazone; quinazolines such as 2-phenyl-4-styrylquinazoline; benzofurans such as 6-hydroxy-2,3-di(p-methoxyphenyl)benzofuran; α-stilbenes such as p-(2,2-diphenylvinyl)-N,N-diphenylaniline; enamines; carbazoles such as N-ethylcarbazole; hole transport materials such as poly-N-vinylcarbazole and derivatives thereof; quinones such as chloranil and bromoanthraquinone; tetracyanoquinodimethanes; fluorenones such as 2,4,7-trinitrofluorenone and 2,4,5,7-tetranitro-9-fluorenone; xanthones; electron transport materials such as thiophenes; and polymers having groups containing the above compounds in the main chain or side chain thereof. These charge transport materials may be used alone or as a combination of two or more thereof.

Examples of binder resins for the charge transport layer 342 include the binder resins as listed above for the charge generating layer 341 as well as resins such as chlorine rubbers and organic photoconductive polymers such as polyvinylcarbazole, polyvinylanthracene, and polyvinylpyrene. These binder resins may be used alone or as a mixture of two or more thereof.

The charge transport layer 342 is formed by applying a coating solution containing the above materials to the charge generating layer 341. Examples of coating processes include the coating processes as listed above for the charge generating layer 341. The charge transport layer 342 has a thickness of, for example, 5 to 50 μm.

The layers forming the photosensitive layer 34 may contain additives such as antioxidants, light stabilizers, and heat stabilizers to prevent deterioration due to ozone and nitrogen oxides produced in the body 10 of the image-forming apparatus 1, or due to light or heat.

If the coating 32 includes the surface protective layer 35, as illustrated in FIG. 4B, the surface protective layer 35 is formed on the photosensitive layer 34 in the step of forming the coating 32.

Through the above steps, the photoreceptor drum substrate 30 is manufactured.

Surface Roughening of Photoreceptor

If the as-manufactured electrophotographic photoreceptor drum substrate 30, on which, as described above, the coating 32 is formed by coating and curing, is mounted in the image-forming apparatus 1 for use as the photoreceptor drum 3, its surface remains specular or nearly specular with extremely low surface roughness. This specularity results from factors such as the method used to form the coating 32, the properties of the materials forming the coating 32, and the additives added to ensure uniform thickness.

If the as-manufactured electrophotographic photoreceptor drum substrate 30 is mounted in the image-forming apparatus 1 as the photoreceptor drum 3, the leading end of the cleaning blade 8, which generally has relatively low hardness for high cleaning performance, tends to closely contact the surface of the photoreceptor drum substrate 30. As a result, the cleaning blade 8 exhibits excessive coefficients of static friction and kinetic friction μ on the surface of the photoreceptor drum substrate 30. This excessive friction often cause problems such as "blade noise" (unusual sound due to fine vibrations of the leading end of the cleaning blade 8), "turning-up" (flipping of the leading end of the cleaning blade 8 downstream in the rotational direction of the photoreceptor drum 3), and "chipping" (breakage of the leading end of the cleaning blade 8). In particular, the problems such as "blade noise," "turning-up," and "chipping" of the cleaning blade 8 often occur noticeably if a comparatively soft cleaning blade 8 with relatively low rubber hardness (JIS-A hardness) is used for high cleaning performance.

Figure 19A:
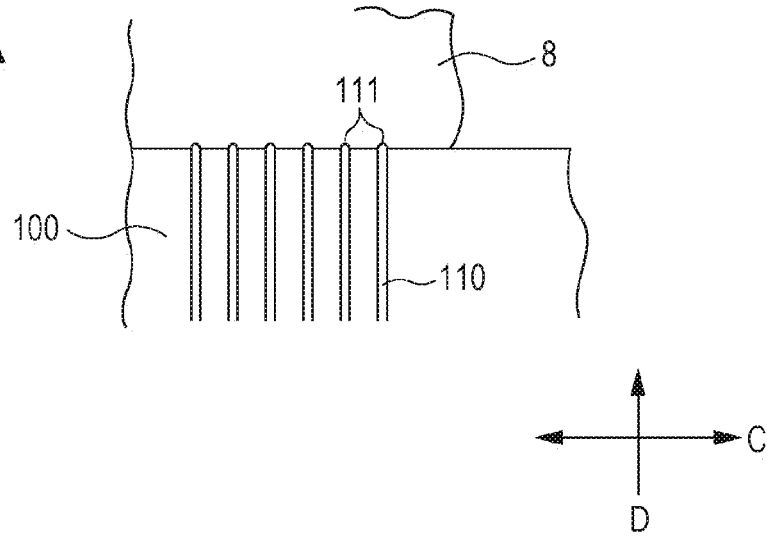
FIGS. 19A and 19B are schematic views illustrating the results obtained by a related-art method for roughening the surface of a photoreceptor, where

To address such problems, as described above, one related-art technique intentionally roughens the surface of an electrophotographic photoreceptor during manufacture. This technique involves roughening the surface of an electrophotographic photoreceptor by rotating the photoreceptor in contact with a polishing member along the axis thereof. As a result, as illustrated in FIG. 19A, lines 110 due to polishing extending in the rotational direction (circumferential direction) D of an electrophotographic photoreceptor 100 are formed on the surface of the photoreceptor 100.

Research by the inventors, however, has shown that the surface-roughened electrophotographic photoreceptor 100 has the following technical drawback.

Figure 19B:
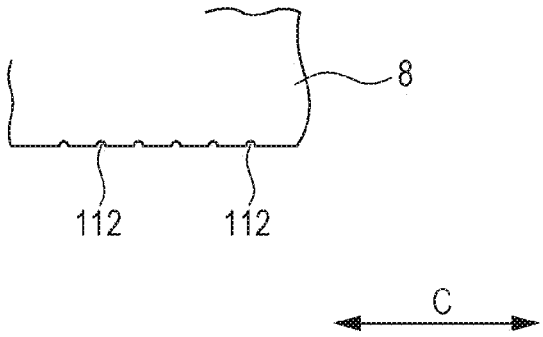

If the electrophotographic photoreceptor 100 is polished in the direction equal to the rotational direction D, ridges and grooves (lines 110) due to polishing are formed on the surface of the photoreceptor 100 at particular positions in the axial direction C of the photoreceptor 100. When the thus-polished electrophotographic photoreceptor 100 is used for image formation, ridges 111 along the lines 110 due to polishing formed on the surface of the photoreceptor 100 act like a file to cut the edge of the cleaning blade 8. As a result, as illustrated in FIG. 19B, the ridges 111 along the lines 110 due to polishing formed on the surface of the photoreceptor 100 cut the edge of the cleaning blade 8 at the corresponding positions 112 in the axial direction C of the photoreceptor 100. Thus, the cleaning blade 8 experiences varying wear conditions in the axial direction C of the photoreceptor 100. Such a cleaning blade 8 allows toner and external additive thereof to leak at severely worn positions, thus causing detrimental effects on images. Such detrimental effects include degraded image quality due to contamination of the charging device 4 (contact charging member such as a charging roller), background fog due to a deposit of leaked toner on the background of an image, and variations in image quality due to variations in image density in the axial direction C of the photoreceptor 100 resulting from varying wear conditions of the photoreceptor 100 due to the local wear of the cleaning blade 8. The toner leaks more noticeably as the average particle size thereof is decreased.

Surface Roughening in First Exemplary Embodiment

Intensive research by the inventors has revealed that it is effective to polish particular regions of the surface of the electrophotographic photoreceptor drum substrate 30 as follows.

As illustrated in FIGS. 1, 5, and 6A and 6B, the electrophotographic photoreceptor drum 3 according to the first exemplary embodiment is an electrophotographic photoreceptor drum (substrate 30) that is cylindrical or substantially cylindrical and that has a surface including a coating region E1 in which the coating 32, including the photosensitive layer 34, is formed. The coating region E1 includes an effective region E2 available for image formation and end regions E3 and E4 outside and adjacent to the effective region E2 in the axial direction C. The end regions E3 and E4 are formed as polished surfaces 40 having lines 41 due to polishing extending in a direction crossing the circumferential direction D of the surface of the photoreceptor drum 3.

The effective region E2 available for image formation in the coating region E1 has a length substantially equivalent to the maximum width of the recording paper P used in the image-forming apparatus 1 during transportation (the length of the recording paper P in the axial direction C of the photoreceptor drum 3). The end regions E3 and E4 in the coating region E1 basically occupy the entire coating region E1 excluding the effective region E2. The end regions E3 and E4, however, may be part of the entire coating region E1 excluding the effective region E2, depending on the particular purpose. If the end regions E3 and E4 are part of the entire coating region E1 excluding the effective region E2, they need to be regions that are adjacent to the effective region E2 and, as described later, that the portions of the cleaning blade 8 located outside the effective region E2 contact.

Figure 6A:
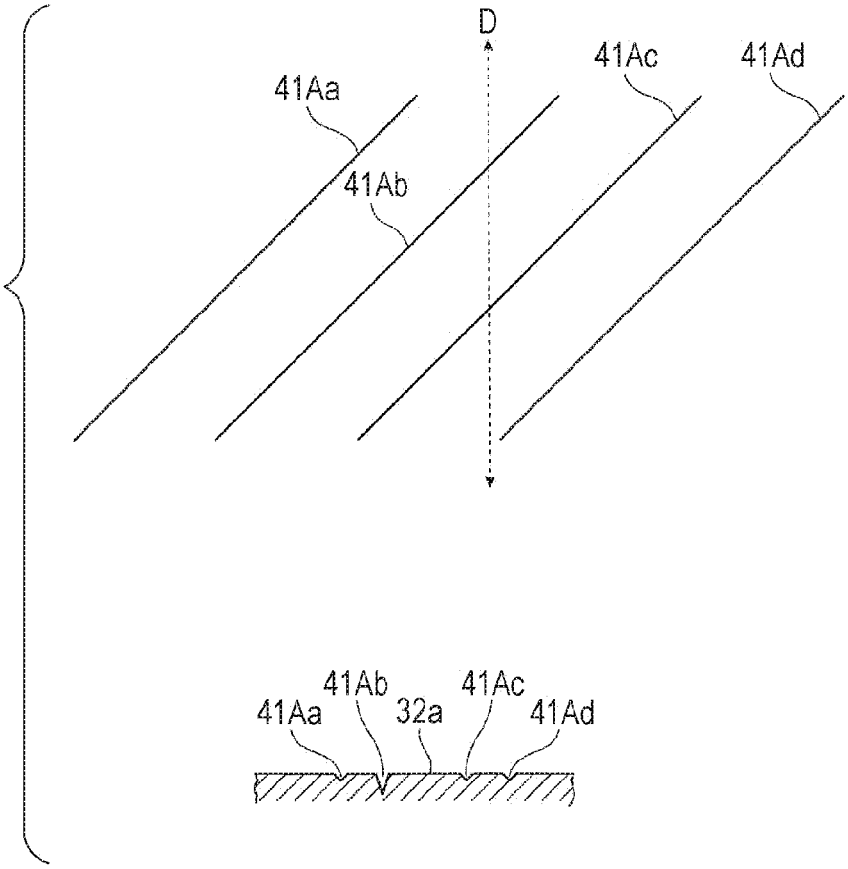
FIGS. 6A and 6B are schematic views illustrating examples of lines due to polishing on polished surfaces in end regions of the surface of the photoreceptor drum shown in FIG. 1.
Figure 6B:
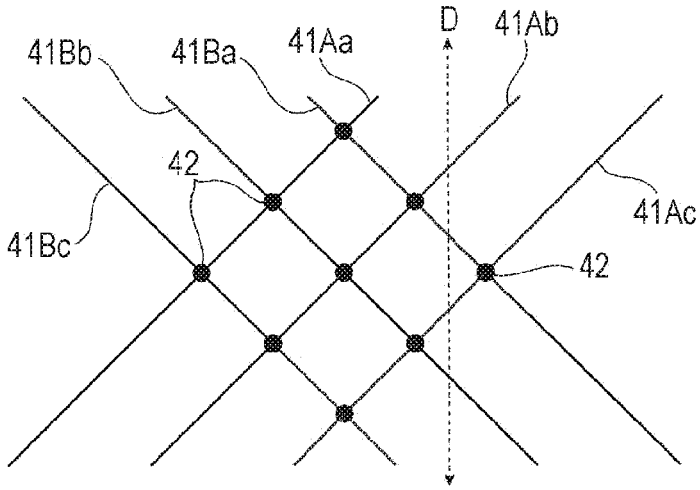

As schematically illustrated in an enlarged view in FIG. 6A, the lines 41 due to polishing on the polished surfaces 40 may extend in the same direction (for example, in an upper-right or upper-left direction) crossing the circumferential direction D (substantially parallel to the rotational direction) of the surface of the photoreceptor drum 3. Alternatively, as illustrated in FIG. 6B, the lines 41 due to polishing may extend in different directions (in upper-right and upper-left directions) crossing the circumferential direction D of the surface of the photoreceptor drum substrate 30 (photoreceptor drum 3). In FIG. 6A, lines 41Aa to 41Ad (collectively referred to as 41A) due to polishing extend in an upper-right direction crossing the circumferential direction D. The polished surfaces 40 are also shown in cross-section in the bottom of FIG. 6A. A portion 32*a* is an unpolished portion (having no lines 41 due to polishing) of the outermost surface of the coating 32. In FIG. 6B, lines 41Ba to 41Bc (collectively referred to as 41B) due to polishing extend in an upper-left direction crossing the circumferential direction D.

The lines 41 due to polishing often vary in width, depth, and length. The lines 41 due to polishing extending in the same direction have substantially the same angle of inclination or slightly different angles of inclination. The lines 41 due to polishing are formed in the shape (cross-sectional shape) of grooves (depressions) or ridges (protrusions), or both, on the surface of the coating 32. As illustrated in FIG. 6B, the grooves and ridges due to polishing are often larger (for example, in width) at intersections 42 (indicated by the black dots in the figure as representative examples) of the lines 41A and 41B due to polishing, which extend in different directions, than at other positions.

The two end regions E3 and E4 outside and adjacent to the effective region E2 in the coating region E1 may be formed as polished surfaces 40 having the same (or similar) type of lines 41 due to polishing or as polished surfaces 40 having different types of lines 41 due to polishing. Examples of types of lines 41 due to polishing will be illustrated later.

Figure 5:
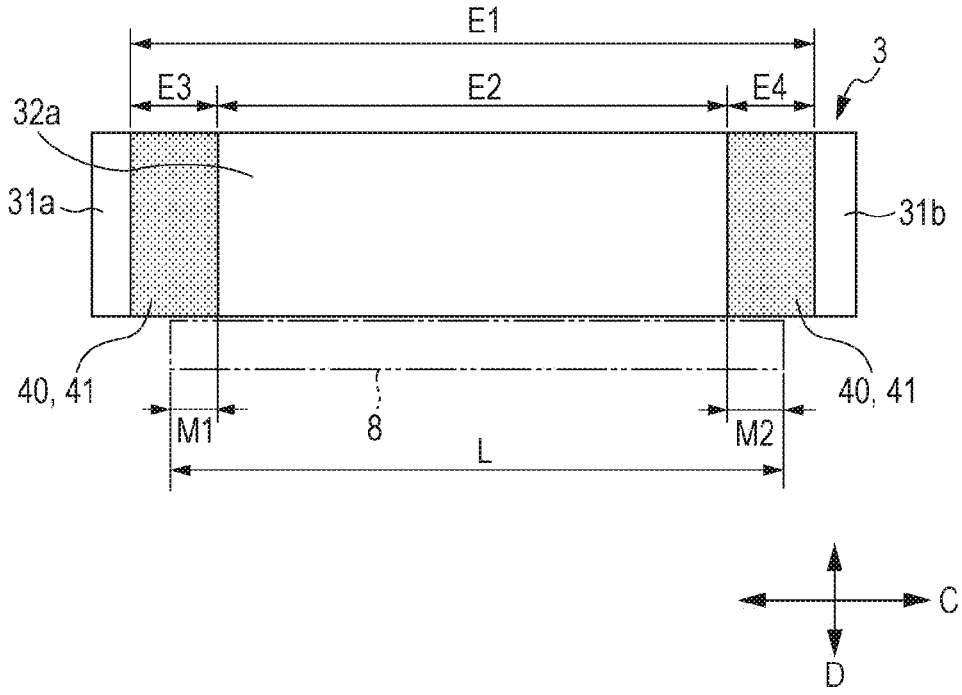
FIG. 5 is a schematic view illustrating the structure of the photoreceptor drum shown in FIG. 1 (including the relationship with a cleaning blade)

As illustrated in FIGS. 1 and 5, the electrophotographic photoreceptor drum 3 has the polished surfaces 40 in the end regions E3 and E4 in the coating region E1 and an unpolished surface in the coating region E1 excluding the end regions E3 and E4, namely, in the effective region E2. The effective region E2, being unpolished, is a surface having the specular or nearly specular condition of the outermost surface of the coating 32 after the step of forming the coating 32.

When the electrophotographic photoreceptor drum 3 (or the process cartridge 20 including the photoreceptor drum 3) is used by mounting the photoreceptor drum 3 on the image-forming section 2 of the image-forming apparatus 1, as illustrated in FIG. 5, the leading end (exactly, the edge) of the cleaning blade 8 in the cleaning device 7 contacts the coating region E1 substantially over the entire length thereof in the axial direction C.

In this case, the leading end of the cleaning blade 8 contacts the effective region E2 and part of the end regions E3 and E4 in the coating region E1 of the surface of the photoreceptor drum 3. Thus, the cleaning blade 8 is used with the leading end thereof contacting the effective region E2, which is a specular surface, and part of the end regions E3 and E4, which are the polished surfaces 40, in the coating region E1 of the surface of the photoreceptor drum 3. In FIG. 5, the cleaning blade 8 contacts the surface of the photoreceptor drum 3 over a width L and contacts the end regions E3 and E4 (polished surfaces 40) of the surface of the photoreceptor drum 3 over widths M1 and M2, respectively.

Polishing Step

The polished surfaces 40 in the surface of the electrophotographic photoreceptor drum 3 are formed by a polishing step described below. The polishing step is carried out as one of the series of steps of manufacturing the electrophotographic photoreceptor drum substrate 30 or as an independent manufacturing step temporally and/or spatially separated from the series of steps of manufacturing the electrophotographic photoreceptor drum substrate 30.

Figure 7:
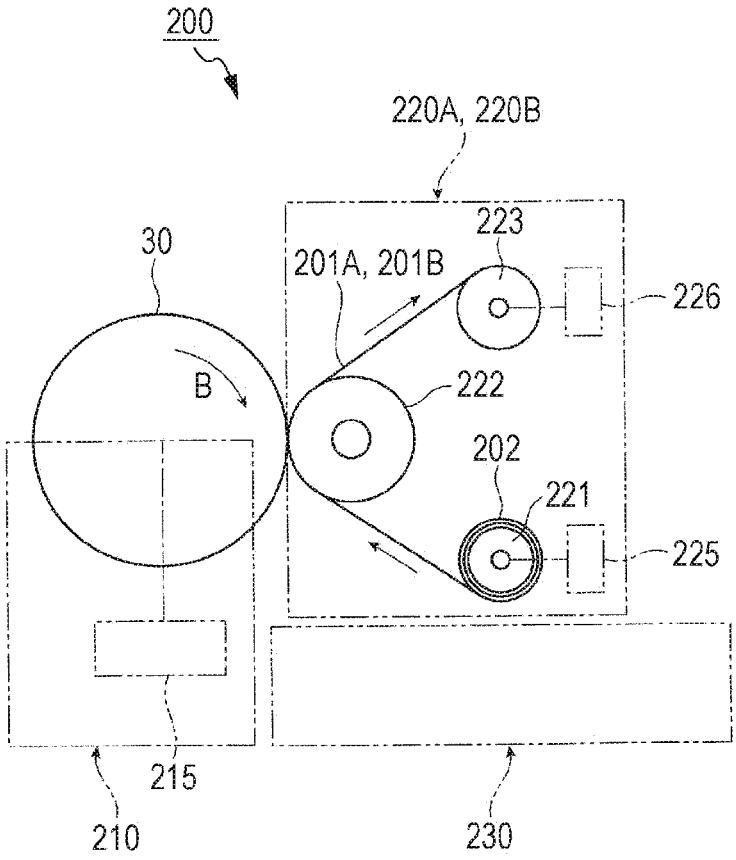
FIG. 7 is a schematic view of an apparatus for polishing the photoreceptor drum substrate.

The polishing step is carried out using, for example, a polishing apparatus 200 having the structure described below. Referring to FIG. 7, the polishing apparatus 200 includes a rotating support unit 210 that supports and rotates the electrophotographic photoreceptor drum substrate 30 having the coating 32 formed thereon, two polishing units 220A and 220B equipped with polishing members 201 that polish particular regions of the surface of the photoreceptor drum substrate 30, and a moving unit 230 that moves the two polishing units 220A and 220B in a predetermined direction.

The rotating support unit 210 of the polishing apparatus 200 includes, for example, a structural part that rotatably supports the electrophotographic photoreceptor drum substrate 30 and a rotating part that rotates the supported electrophotographic photoreceptor drum substrate 30 at a predetermined speed in a predetermined direction. The rotating part includes a motor 215 and a rotation transmission mechanism. The rotating support unit 210 supports and rotates the electrophotographic photoreceptor drum substrate 30 having the coating 32 formed thereon at a predetermined rotational speed.

The rotational speed of the electrophotographic photoreceptor drum substrate 30 in the polishing step may be set to any speed, for example, to a speed lower than, higher than, or equal to the rotational speed (process speed) of the photoreceptor drum 3 in the image-forming apparatus 1 in image-forming operation. It is desirable, however, to set the rotational speed of the photoreceptor drum substrate 30 to a speed higher than the process speed of the photoreceptor drum 3 taking into account the number of photoreceptor drum substrates 30 that can be polished per unit time, that is, the productivity of the polishing step.

There is no need to set an upper or lower limit to the rotational speed of the photoreceptor drum substrate 30. In view of the precision and productivity of the polishing step, the rotational speed of the photoreceptor drum substrate 30 may be set to, for example, 100 to 1,500 rpm for an electrophotographic photoreceptor drum substrate 30 having a diameter of 40 mm. A rotational speed lower than 100 rpm is tolerable in terms of the accuracy of the polishing step, although such a rotational speed is undesirable in that the productivity decreases because it takes a longer period of time to polish the surface of one electrophotographic photoreceptor drum substrate 30. A rotational speed higher than 1,500 rpm is desirable in terms of productivity because it takes a shorter period of time to polish the surface of one electrophotographic photoreceptor drum substrate 30. An excessive rotational speed, however, is undesirable in that the coating 32 of the photoreceptor drum substrate 30 may be damaged by frictional heat from the contact of the surface of the photoreceptor drum substrate 30 with the polishing members 201. Nevertheless, the rotational speed of the photoreceptor drum substrate 30 may be set to a speed higher than 1,500 rpm if the risk of damage to the coating 32 of the electrophotographic photoreceptor 100 by frictional heat during polishing is avoided, for example, by cooling the surface of the coating 32 of the photoreceptor drum substrate 30 during polishing.

The polishing units 220A and 220B of the polishing apparatus 200 include, for example, strip-shaped polishing sheets as the polishing members 201. In this case, the polishing units 220A and 220B each include a feed roller 221 that feeds the polishing sheet 201, as a polishing member, wound therearound into a polishing sheet roll 202, a pressing roller 222 that presses the fed portion of the polishing sheet 201 against the portion to be polished of the surface of the photoreceptor drum substrate 30, a takeup roller 223 around which the portion of the polishing sheet 201 subjected to polishing is wound, a rotating part that rotates the feed roller 221 at a predetermined speed, and a rotating part that rotates the takeup roller 223 at a predetermined speed. The rotating part for the feed roller 221 includes a motor 225 and a rotation transmission mechanism. The rotating part for the takeup roller 223 includes a motor 226 and a rotation transmission mechanism.

The polishing sheet 201 is, for example, a lapping film sheet. A lapping film sheet is, for example, a synthetic resin film, such as a polyester film, that has uniform thickness and a smooth surface and that is coated with abrasive particles, such as aluminum oxide particles, having a predetermined particle size distribution (that has a polishing layer formed thereon). A lapping film sheet coated with abrasive particles of controlled particle size may be used as the polishing sheet 201 to perform uniform, ultraprecision polishing to a surface roughness of about 0.01 μm in terms of calculated average roughness (Ra). A lapping film sheet is also economical and suitable for polishing the surface of an electrophotographic photoreceptor drum because the desired surface roughness is achieved within a short period of time by a simple polishing process.

Examples of polishing sheets include those having fine aluminum oxide particles (abrasive particles) with varying particle sizes, such as 0.3 μm, 1 μm, 3 μm, 5 μm, 10 μm, 30 μm, 40 μm, and 60 μm. A polishing sheet is selected that has a predetermined particle size depending on the polishing condition required of the polished surfaces 40 in the surface of the electrophotographic photoreceptor drum 3.

The length (polishing width) K of the polishing sheets 201 in the axial direction C of the photoreceptor drum substrate 30 is smaller (narrower) than the widths W3 and W4 of the end regions E3 and E4 in the coating region E1 of the surface of the photoreceptor drum substrate 30 in the axial direction C. The polishing width K of the polishing sheets 201 may be set to any width, for example, to about 5 to 10 mm, depending on the widths W3 and W4 of the end regions E3 and E4. The widths W3 and W4 of the end regions E3 and E4 are typically equal, although they may be different.

As described above, the polishing sheets 201 are used as the polishing sheet rolls 202. The polishing sheets 201 can be gradually supplied from the polishing sheet rolls 202 for polishing, and the used portion of the polishing sheets 201 can be taken up. This allows polishing while replacing the polishing surfaces of the polishing sheets 201 with new surfaces, thus contributing to automation and speedup of the polishing step.

In the polishing units 220A and 220B, the feed rollers 221 and the take-up rollers 223 are independently rotated by the respective rotating parts. The polishing sheets 201 are supplied from the feed rollers 221 to the particular regions E3 and E4 of the surface of the electrophotographic photoreceptor drum substrate 30 and are taken up by the takeup rollers 223. The pressing rollers 222 pushes the backsides of the polishing sheets 201 to press the polishing surfaces thereof against the particular regions E3 and E4 of the surface of the photoreceptor drum substrate 30 at a predetermined pressure.

The pressure at which the pressing rollers 222 press the polishing sheets 201 against the surface of the photoreceptor drum substrate 30 directly influences the polishing properties thereof. The pressure is appropriately set depending on the factors such as the surface roughness of the polishing sheets 201 and the polishing condition of the polished surfaces 40 formed in the surface of the photoreceptor drum substrate 30. The pressing rollers 222 include a rotating shaft and an elastic layer, such as a rubber layer, formed thereon. The pressing rollers 222 are rotated as the polishing sheets 201 are fed (taken up).

The feed direction (indicated by the arrows) of the polishing sheets 201 in the polishing units 220A and 220B may be equal or opposite to the rotational direction of the photoreceptor drum substrate 30 on the rotating support unit 210 (equal or opposite at the contacts positions thereof). In the first exemplary embodiment, as illustrated in FIG. 7, the feed direction of the polishing sheets 201 is opposite to the rotational direction B of the photoreceptor drum substrate 30 at the contact positions thereof.

The moving unit 230 of the polishing apparatus 200 includes a moving support structural part and a moving part. The moving support structural part supports the polishing units 220A and 220B such that they are movable toward and away from the surface of the electrophotographic photoreceptor drum substrate 30 supported by the rotating support unit 210 and are also movable in the axial direction C of the photoreceptor drum substrate 30. The moving part moves the polishing units 220A and 220B supported by the moving support structural part at a predetermined moving speed in a predetermined direction.

The moving support structural part includes, for example, a guide rail. The moving part includes, for example, a ball screw rotatable by a motor or a timing belt. The moving support structural part may support the polishing units 220A and 220B such that they are movable in a direction crossing the circumferential direction D of the photoreceptor drum substrate 30 (excluding the axial direction C) in which the polished surfaces 40 having the desired lines 41 due to polishing can be formed.

For example, the moving unit 230 of the polishing apparatus 200 moves the polishing units 220A and 220B in one of the first to third moving (polishing) patterns described below.

Figure 8A:
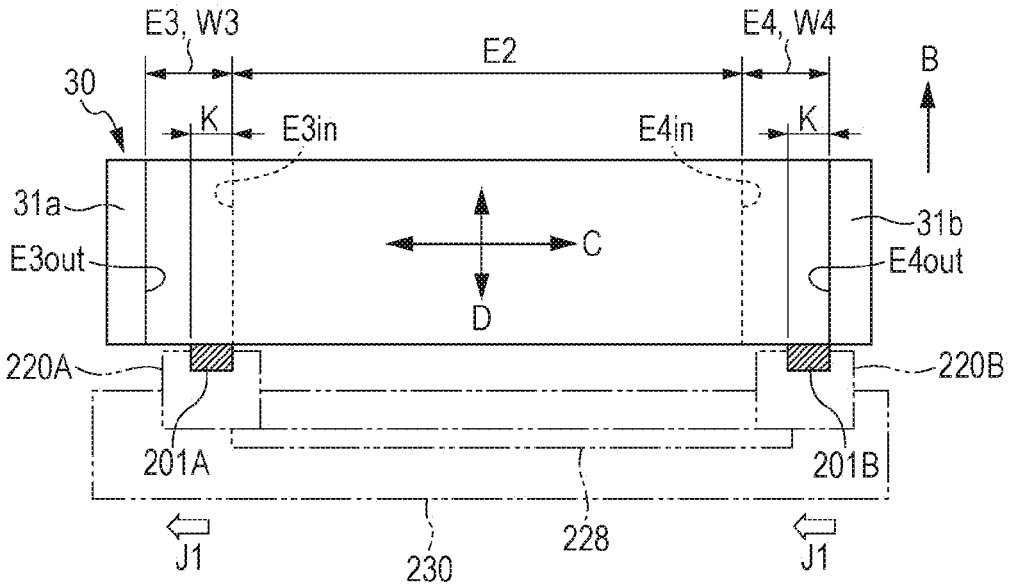
FIGS. 8A and 8B are schematic views illustrating an example of the moving (polishing) pattern (first moving pattern) of polishing members relative to the photoreceptor drum substrate, where
Figure 8B:
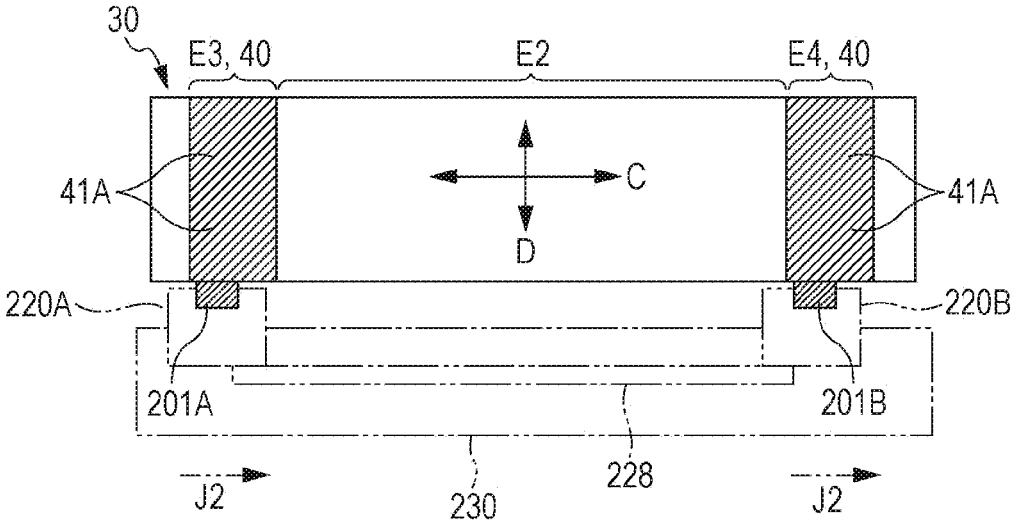

In the first moving (polishing) pattern illustrated in FIGS. 8A and 8B, the polishing units 220A and 220B are moved such that polishing sheets 201A and 201B simultaneously contact the end regions E3 and E4, respectively, of the surface of the photoreceptor drum substrate 30 at one end thereof (see FIG. 8A). The polishing units 220A and 220B are then simultaneously moved in the same direction J1 along the axial direction C of the photoreceptor drum substrate 30 (see FIG. 8B). For the first pattern, as indicated by the two-dot chain lines in FIGS. 8A and 8B, the two polishing units 220A and 220B may be joined together with a coupling member 228 to accurately synchronize the simultaneous movement in the same direction.

In the first exemplary embodiment, the polishing sheet 201A (an end of the polishing width K) contacts the end region E3 of the photoreceptor drum substrate 30 so as to be present at an inner end position E3 in thereof. The polishing sheet 201B (an end of the polishing width K) contacts the end region E4 of the photoreceptor drum substrate 30 so as to be present at an outer end position E4out thereof. The polishing sheets 201A and 201B are then moved together in the same direction J1. The direction J1 is a direction in which the polishing sheet 201A, for example, is moved from the inner end position E3 in to an outer end position E3out of the end region E3.

The movement in the same direction J1 is continued until, for example, the other end of the polishing width K of the polishing sheet 201A is moved from the initial position, where it starts contacting the end region E3 of the photoreceptor drum substrate 30, to the outer end position E3out. The movement is also continued until the other end of the polishing width K of the polishing sheet 201B is moved from the initial position, where it starts contacting the end region E4 of the photoreceptor drum substrate 30, to the inner end position E4 in. After the movement (polishing) is complete, the moving unit 230 moves the polishing units 220A and 220B away from the surface of the photoreceptor drum substrate 30. The movement away from the surface of the photoreceptor drum substrate 30 is also performed in the second and third patterns.

If the end regions E3 and E4 of the surface of the photoreceptor drum substrate 30 are polished in the first moving pattern (one-way movement in the same direction J1), as schematically illustrated in FIG. 8B, the end regions E3 and E4 are formed as polished surfaces 40 having lines 41A due to polishing formed by fine ridges and grooves extending in an upper-right direction crossing the circumferential direction D of the photoreceptor drum substrate 30 (see FIG. 6A). As described above, the lines 41A due to polishing are formed by rotating the photoreceptor drum substrate 30 in the direction indicated by arrow B during polishing (which also applies to the second and third patterns). The first moving pattern allows the end regions E3 and E4 to be polished in the simplest manner and within the shortest period of time.

Figure 9A:
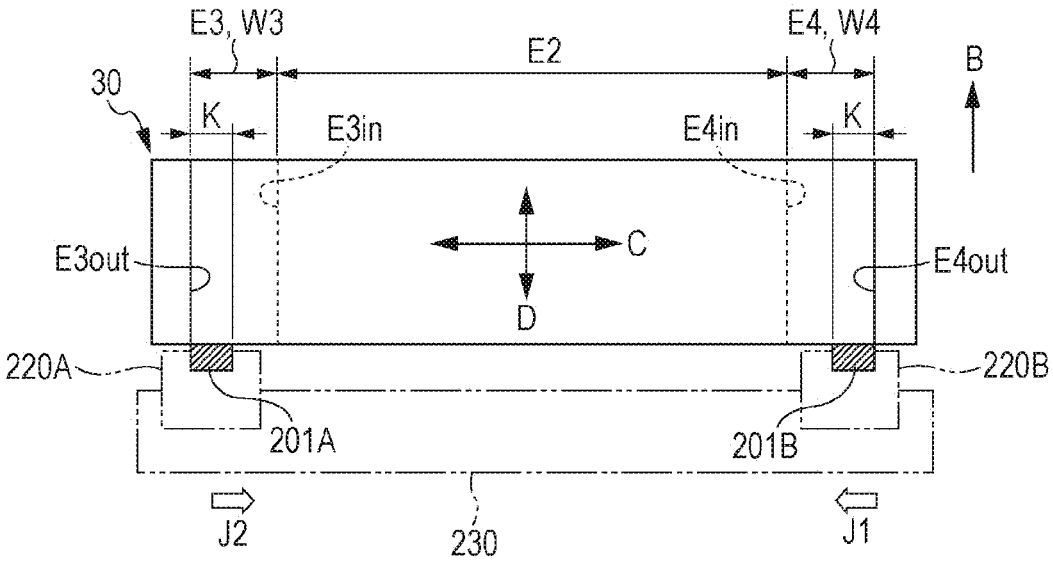
FIGS. 9A and 9B are schematic views illustrating another example of the moving pattern (second moving pattern) of the polishing members relative to the photoreceptor drum substrate, where
Figure 9B:
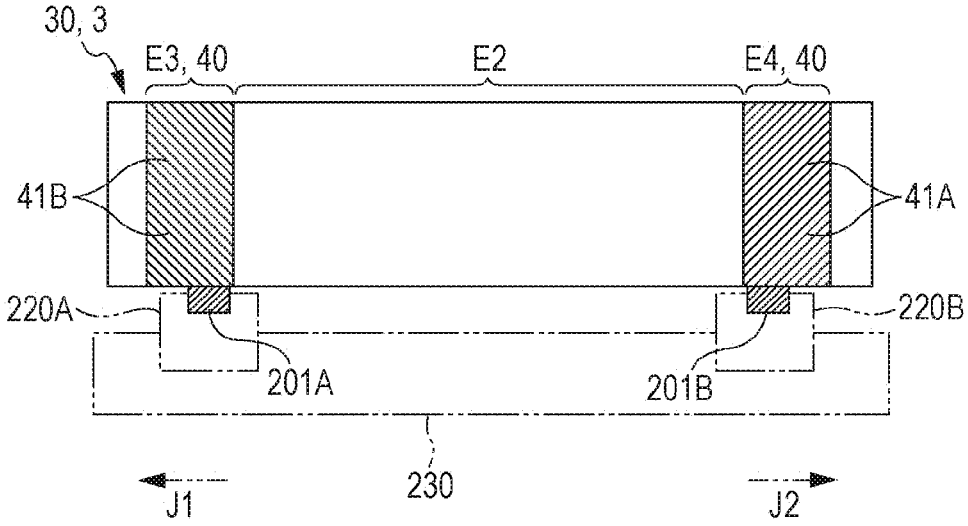

In the second moving (polishing) pattern illustrated in FIGS. 9A and 9B, the polishing units 220A and 220B are moved such that the polishing sheets 201A and 201B simultaneously contact the end regions E3 and E4 of the surface of the photoreceptor drum substrate 30 at the outer end positions E3out and E4out, respectively (see FIG. 9A). The polishing units 220A and 220B are then simultaneously moved in the directions J2 and J1, respectively, along the axial direction C of the photoreceptor drum substrate 30 until they reach the inner end positions E3 in and E4 in of the end regions E3 and E4, respectively (see FIG. 9B). The direction J2 is a direction in which the polishing sheet 201A, for example, is moved from the outer end position E3out to the inner end position E3 in of the end region E3.

If the end regions E3 and E4 of the surface of the photoreceptor drum substrate 30 are polished in the second moving pattern (one-way movement from the outer end position to the inner end position of each end region), as schematically illustrated in FIG. 9B, the end region E3 is formed as a polished surface 40 having lines 41B due to polishing formed by fine ridges and grooves extending in an upper-left direction crossing the circumferential direction D of the photoreceptor drum substrate 30 (see FIG. 6B). The end region E4, as schematically illustrated in FIG. 9B, is formed as a polished surface 40 having lines 41A due to polishing formed by fine ridges and grooves extending in an upper-left direction crossing the circumferential direction D of the photoreceptor drum substrate 30 (see FIG. 6A). The second moving pattern allows the polishing units 220A and 220B (in practice, the polishing sheets 201A and 201B) to be symmetrically moved in opposite directions, thus contributing to more efficient polishing of the end regions E3 and E4. The third moving pattern described below provides the same advantage in polishing.

Figure 10A:
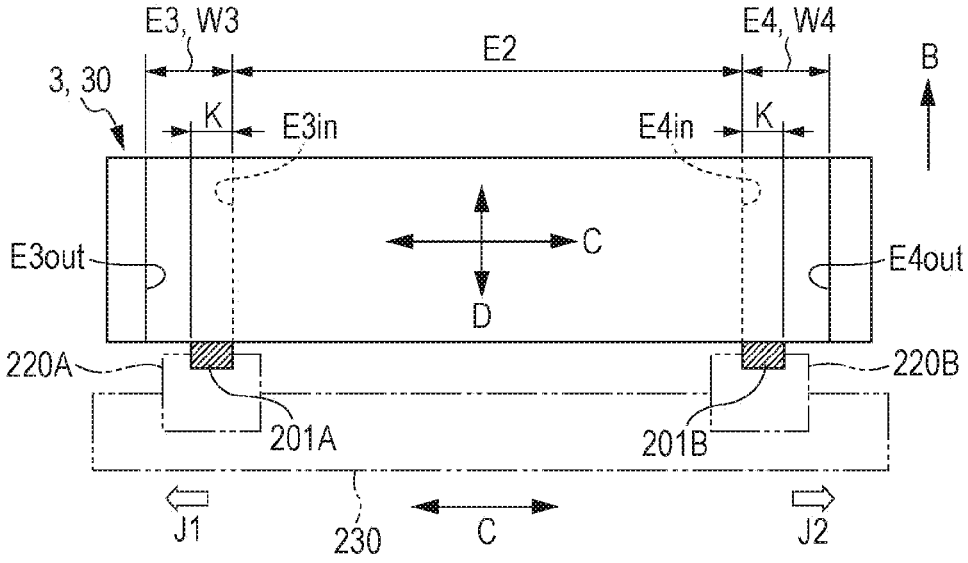
FIGS. 10A and 10B are schematic views illustrating another example of the moving pattern (third moving pattern) of the polishing members relative to the photoreceptor drum substrate, where
Figure 10B:
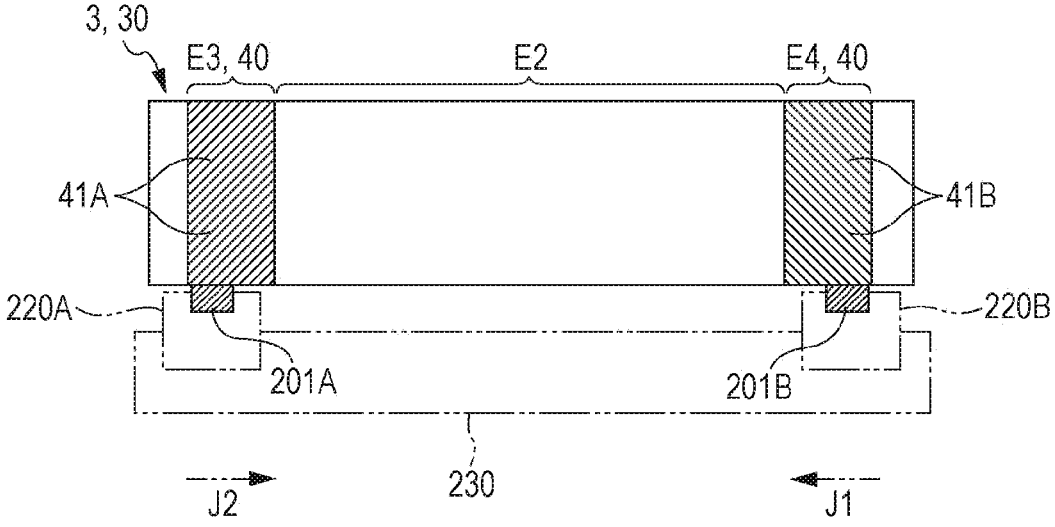

In the third moving (polishing) pattern illustrated in FIGS. 10A and 10B, the polishing units 220A and 220B are moved such that the polishing sheets 201A and 201B simultaneously contact the end regions E3 and E4 of the surface of the photoreceptor drum substrate 30 at the inner end positions E3 in and E4 in, respectively (see FIG. 10A). The polishing units 220A and 220B are then simultaneously moved in the directions J1 and J2, respectively, along the axial direction C of the photoreceptor drum substrate 30 until they reach the outer end positions E3out and E4out of the end regions E3 and E4, respectively (see FIG. 10B).

If the end regions E3 and E4 of the surface of the photoreceptor drum substrate 30 are polished in the third moving pattern (one-way movement from the inner end position to the outer end position of each end region), as schematically illustrated in FIG. 10B, the end region E3 is formed as a polished surface 40 having lines 41A due to polishing formed by fine ridges and grooves extending in an upper-left direction crossing the circumferential direction D of the photoreceptor drum substrate 30 (see FIG. 6A). The end region E4, as schematically illustrated in FIG. 10B, is formed as a polished surface 40 having lines 41B due to polishing formed by fine ridges and grooves extending in an upper-left direction crossing the circumferential direction D of the photoreceptor drum substrate 30 (see FIG. 6B).

In the first to third moving patterns, the polishing units 220A and 220B may be moved back and forth such that the polishing sheets 201A and 201B contact the end regions E3 and E4 of the surface of the photoreceptor drum substrate 30 multiple times. For polishing by moving the polishing units 220A and 220B back and forth, a function for switching the movement direction of the polishing units 220A and 220B at a predetermined timing is added to the moving unit 230. The polishing units 220A and 220B may be moved back and forth either once or multiple times.

For the first moving pattern, for example, as indicated by the arrow-headed two-dot chain lines in FIG. 8B, the polishing units 220A and 220B are simultaneously moved in the same direction J1 along the axial direction C of the photoreceptor drum substrate 30 and are then simultaneously moved back in the direction J2 opposite to the direction J1. For the second moving pattern, for example, as indicated by the arrow-headed two-dot chain lines in FIG. 9B, the polishing units 220A and 220B are moved to the inner end positions E3 in and E4 in of the end regions E3 and E4 and are then simultaneously moved back in the directions J1 and J2, respectively, until they reach the outer end positions E3out and E4out of the end regions E3 and E4. For the third moving pattern, for example, as indicated by the arrow-headed two-dot chain lines in FIG. 10B, the polishing units 220A and 220B are moved to the outer end positions E3out and E4out of the end regions E3 and E4 and are then simultaneously moved back in the directions J2 and J1, respectively, until they reach the inner end positions E3 in and E4 in of the end regions E3 and E4.

If the end regions E3 and E4 of the surface of the photoreceptor drum substrate 30 are polished by moving the polishing units 220A and 220B back and forth, as illustrated in FIG. 6B, the end regions E3 and E4 are formed as polished surfaces 40 having crossing lines 41A and 41B due to polishing formed by fine ridges and grooves extending in different directions crossing the circumferential direction D of the photoreceptor drum substrate 30.

The speed at which the moving unit 230 of the polishing apparatus 200 moves the polishing units 220A and 220B (in practice, the polishing sheets 201A and 201B) in the axial direction C of the photoreceptor drum substrate 30 may be set to any speed, depending on, for example, the rotational speed of the photoreceptor drum substrate 30 during polishing and productivity. The moving speed is set to, for example, about 25 to 100 mm/sec, although it may be set to a speed higher or lower than this range.

The number of times the surface of the photoreceptor drum substrate 30 is polished at the same position in the particular regions, namely, the end regions E3 and E4, depends on the moving speed of the polishing sheets 201A and 201B as well as the rotational speed of the photoreceptor drum substrate 30. That is, the number of times the surface of the photoreceptor drum substrate 30 is polished at the same position in the particular regions increases as the moving speed becomes higher relative to the rotational speed of the photoreceptor drum substrate 30. Conversely, the number of times the surface of the photoreceptor drum substrate 30 is polished at the same position in the particular regions decreases as the moving speed becomes lower relative to the rotational speed of the photoreceptor drum substrate 30.

The polishing condition of the end regions E3 and E4 of the surface of the photoreceptor drum substrate 30 depends on the number of times the surface of the photoreceptor drum substrate 30 is polished as well as the surface roughness of the polishing sheets 201A and 201B.

The number of times the surface of the photoreceptor drum substrate 30 is polished in the end regions E3 and E4 means how many times the two polishing sheets 201A and 201B contact and polish the end regions E3 and E4 of the surface of the photoreceptor drum substrate 30 at the same position as they are moved across the end regions E3 and E4 from one end position to the other end position in a single polishing process. This does not mean how many times the polishing sheets 201A and 201B are moved across the end regions E3 and E4 of the surface of the photoreceptor drum substrate 30 from one end position to the other end position, in other words, the number of times the polishing process is executed.

The number of times the surface of the photoreceptor drum substrate 30 is polished depends on the rotational speed of the photoreceptor drum substrate 30 and the polishing width K and moving speed of the polishing sheets 201A and 201B. For example, if polishing sheets 201 having a polishing width K of 10 mm are moved across the end regions E3 and E4 in the axial direction C of the photoreceptor drum substrate 30 while rotating the photoreceptor drum substrate 30 at a rotational speed of 335 mm/sec, the moving speed of the polishing sheets 201 is set such that the ratio of the moving speed of the polishing sheets 201 to the rotational speed of the photoreceptor drum substrate 30 is, for example, 1:5 to 1:50. That is, if the rotational speed of the photoreceptor drum substrate 30 is the above rotational speed (335 mm/sec), the moving speed of the polishing sheets 201 is set to, for example, about 25 to 100 mm/sec. The moving speed of the polishing sheets 201, however, is not limited to this range but may be higher or lower than this range.

The results of research by the inventors, as demonstrated by the experimental results described later, have shown that it is desirable that the polishing condition of the surface of the polished surfaces 40 (photoreceptor drum 3) be the condition of the surface of a photoreceptor drum substrate 30 having no polished surface 40 formed thereon after the photoreceptor drum substrate 30 is rotated in contact with the cleaning blade 8 until the measured load torque converges to a certain level with little variation.

This condition is equivalent to the wear condition of the surface of a photoreceptor drum substrate 30 having no polished surface 40 formed thereon after images are formed on about 3,000 sheets of A4-size lateral-feed recording paper P. The results of research by the inventors have shown that the surface of the photoreceptor drum substrate 30 after images are formed on about 3,000 sheets has a calculated average roughness (Ra) of about 0.01 μm and a maximum height (Rmax) of about 0.1 μm.

Step of Assembling Process Cartridge

The thus-manufactured electrophotographic photoreceptor drum 3 is equipped with a flange member for rotatably attaching the photoreceptor drum 3 to a support (frame) of the process cartridge 20 and a flange member having a gear for receiving transmitted torque. The flange members are attached to the ends 31*a* and 31*b* of the conductive support 31 of the photoreceptor drum substrate 30 (the portions outside the coating region E1 where no coating 32 is formed). The attachment of the flange members may be the final step of the process of manufacturing the photoreceptor drum substrate 30 described above.

The photoreceptor drum 3 equipped with the flange members are then rotatably attached to the support (not shown) of the process cartridge 20 with the flange members therebetween. As illustrated in FIG. 3, the charging device (such as the charging roller) and the cleaning device 7 are then attached around the photoreceptor drum 3. Thus, the process cartridges 20 are assembled.

As illustrated in FIG. 2, the thus-assembled process cartridges 20 are mounted in the mounting spaces (not shown) of the image-forming sections 2Y, 2M, 2C, and 2K, respectively, in the body 10 of the image-forming apparatus 1, for example, with guide rails (not shown) therebetween. When the process cartridges 20 are mounted on the predetermined mounting positions, the members of the drive transmission mechanism are attached, the members of the electrical connection system are connected, and other components of the image-forming sections 2 (such as the developing devices 6 and the intermediate transfer section 9) are placed at the same time. Thus, the process cartridges 20 are mounted on the image-forming apparatus 1 and are ready for use.

Image Formation Using Photoreceptor Drum

The image-forming apparatus 1 according to the first exemplary embodiment, having the process cartridges 20 mounted thereon, is ready for image formation using the electrophotographic photoreceptor drums 3. In the process cartridges 20 or the image-forming apparatus 1, as illustrated in FIG. 5, the leading end (8*a*) of the cleaning blade 8 of the cleaning device 7 contacts the effective region E2 and part of the end regions E3 and E4 of the surface of the electrophotographic photoreceptor drum 3.

In the image-forming operation described above, the electrophotographic photoreceptor drum 3 does not cause a problem such as wear of the leading end of the flat cleaning blade 8 at particular positions or poor cleaning due to passage of a developer for image formation (developer or toner for use with the developing devices 6) with a smaller particle size through the cleaning blade 8. The resulting image has few image defects (such as background fog and variations in image quality) attributed to wear of the cleaning blade 8 and poor cleaning due to passage of a developer with a smaller particle size through the cleaning blade 8.

It is known that a leading end of a cleaning blade abutting the surface of a rotating photoreceptor drum generally tends to start wearing on both sides thereof.

For the photoreceptor drum 3 according to the first exemplary embodiment, in contrast, the end regions E3 and E4, which contact both sides of the leading end of the blade 8 (in the longitudinal direction), are formed as polished surfaces 40 having the lines 41 due to polishing. These polished surfaces 40 reduce the frictional resistance between the end regions E3 and E4 of the surface of the drum 3 and both sides of the leading end of the blade 8, thus adequately reducing wear of the leading end of the blade 8 on both sides thereof. In addition, the lines 41 due to polishing on the polished surfaces 40 of the photoreceptor drum 3 extend in a direction crossing the circumferential direction D of the photoreceptor drum 3. Unlike a photoreceptor having the surface thereof roughened by the related-art technique described above (see FIG. 19B), the photoreceptor drum 3 does not wear the leading end of the blade 8, which contacts the polished surfaces 40, at particular positions on both sides thereof. Thus, the leading end of the blade 8, including both sides thereof, wears substantially uniformly after extended use.

In addition, it is known that developers (toners) with smaller average particle sizes (for example, average particle sizes of 7 μm or less) have increasingly been used for purposes such as improved image quality. The cleaning blade 8 is disposed in contact with the effective region E2 of the surface of the rotating photoreceptor drum 3 to remove an undesired deposit such as toner remaining after first transfer. Hence, if the effective region E2 of the surface of the photoreceptor drum 3 is a polished surface 40 as in the end regions E3 and E4, a developer with a smaller particle size might pass between the blade 8 and the surface of the photoreceptor drum 3 (effective region E2) (mainly where the lines 41 due to polishing are present).

For the photoreceptor drum 3 according to the first exemplary embodiment, in contrast, the effective region E2 is not polished as in the end regions E3 and E4 (remains in the same condition as the effective region E2 of the photoreceptor drum substrate 30, that is, specular or nearly specular).

In use, the photoreceptor drum 3 does not cause poor cleaning due to passage of a developer for image formation with a smaller particle size through the leading end of the cleaning blade 8. The passage of a developer with a smaller particle size between the cleaning blade 8 and the surface of the photoreceptor drum 3 in the effective region E2 might occur noticeably if a bias voltage having an alternating-current voltage superimposed thereon is applied to the charging device 4. With the photoreceptor drum 3, however, the passage of a developer with a smaller particle size can be prevented even if such a bias voltage is applied to the charging device 4.

EXAMPLES

To examine the polishing conditions for the end regions E3 and E4 of the surfaces of electrophotographic photoreceptor drums 3 manufactured by the method described above, the inventors fabricate a bench model of an image-forming apparatus for use with the electrophotographic photoreceptor drums 3. The inventors then conduct experiments to examine the surface condition of the photoreceptor drums 3, including the surface roughness of the photoreceptor drums 3, the drive torque of the photoreceptor drums 3, and the visual inspection of the surfaces of the photoreceptor drums 3 under a microscope.

In Example 1, the end regions E3 and E4 of the surface of the electrophotographic photoreceptor drum substrate 30 are polished by moving the two polishing sheets 201A and 201B twice in the first moving pattern in one direction (J1) along the axial direction C, for example, in several tens of seconds to several minutes. In Example 2, the end regions E3 and E4 of the surface of the electrophotographic photoreceptor drum substrate 30 are polished by moving the polishing sheets 201A and 201B back and forth in the first moving pattern in the axial direction C, for example, in several tens of seconds to several minutes. In Example 3, the end regions E3 and E4 of the surface of the electrophotographic photoreceptor drum substrate 30 are polished by moving the polishing sheets 201A and 201B back and forth in the first moving pattern in the axial direction C at twice the speed of Example 2, for example, in several tens of seconds. In a comparative example, the photoreceptor drum substrate 30 is not polished (as-manufactured). In another comparative example, the photoreceptor drum substrate 30 is manually polished using a 3,000 grit polishing sheet.

Surface Roughness

Figure 11:
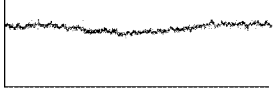
FIG. 11 is a series of graphs showing the surface roughness measured in the end regions of electrophotographic photoreceptor drums used in the Examples immediately after polishing.
Figure 11:
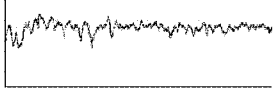
Figure 11:
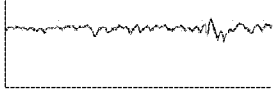
Figure 11:
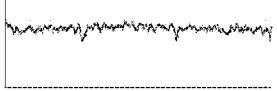
Figure 11:
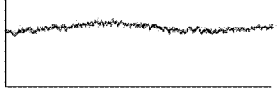
Figure 12:
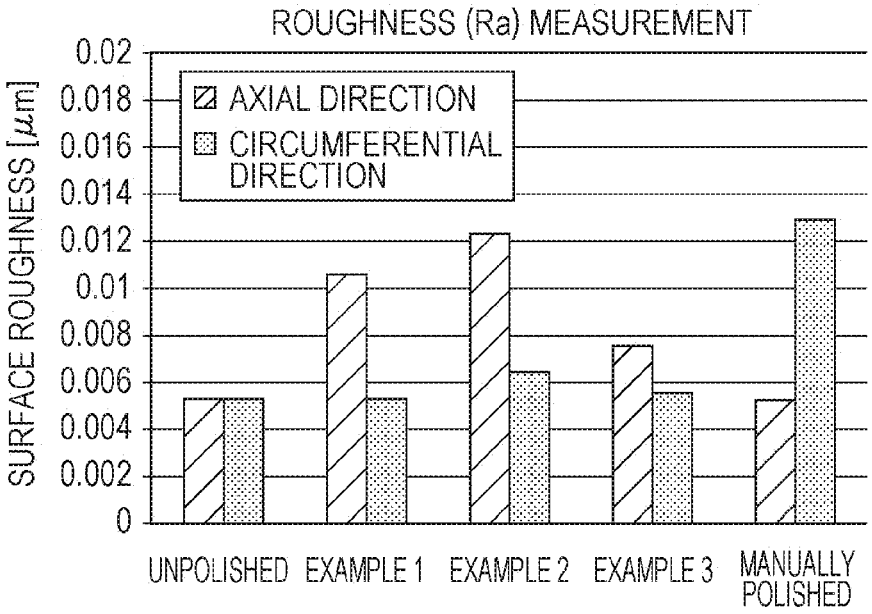
FIG. 12 is a graph depicting the measured surface roughness (Ra) in FIG. 11 as a bar chart.
Figure 13:
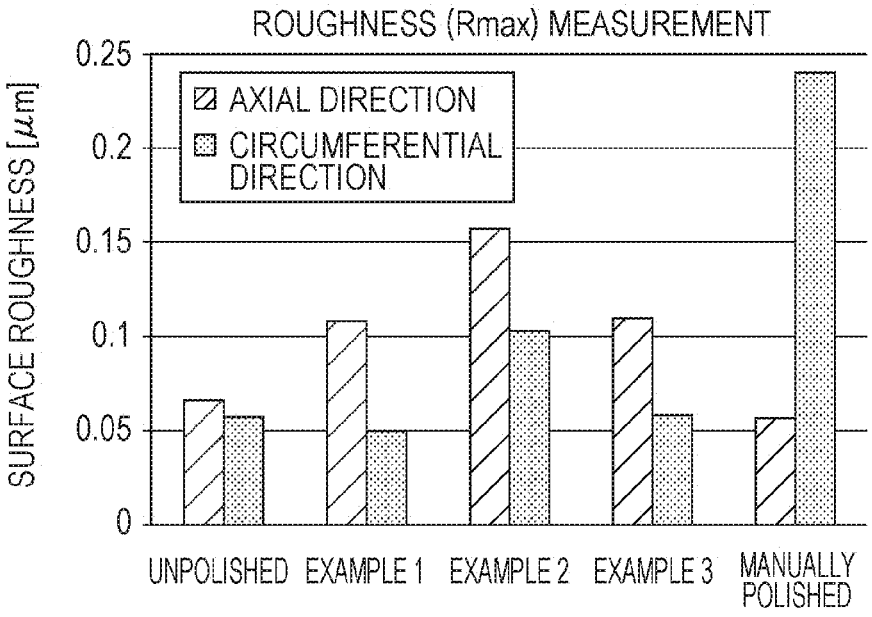
FIG. 13 is a graph depicting the measured surface roughness (Rmax) in FIG. 11 as a bar chart.
Figure 14:
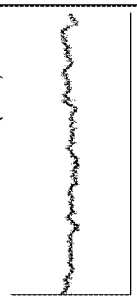
FIG. 14 is a series of graphs showing the surface roughness measured in the end regions of the electrophotographic photoreceptor drums used in the Examples after use in image formation.
Figure 14:
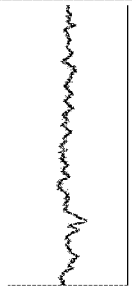
Figure 14:
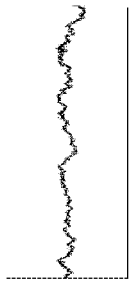
Figure 14:
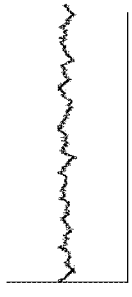
Figure 14:
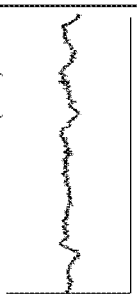
Figure 15:
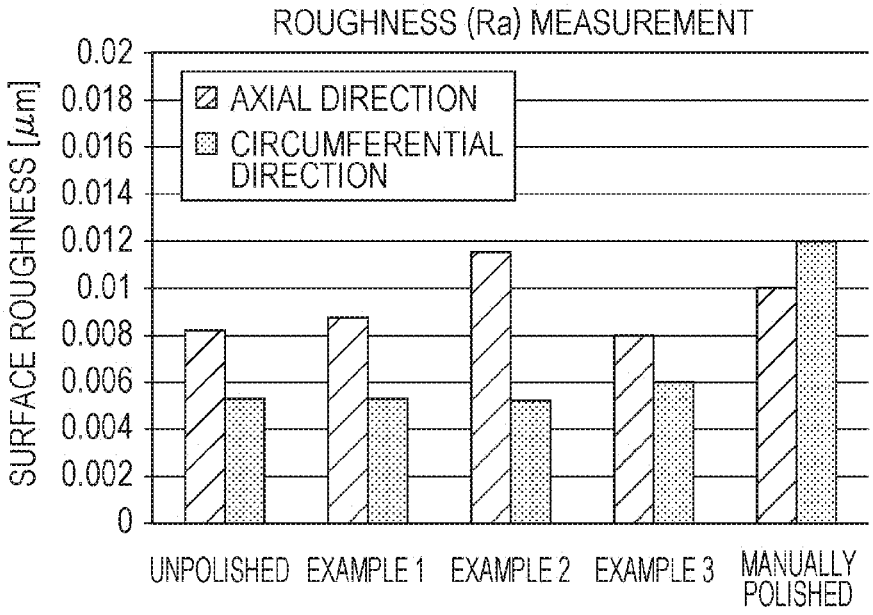
FIG. 15 is a graph depicting the measured surface roughness (Ra) in FIG. 14 as a bar chart.
Figure 16:
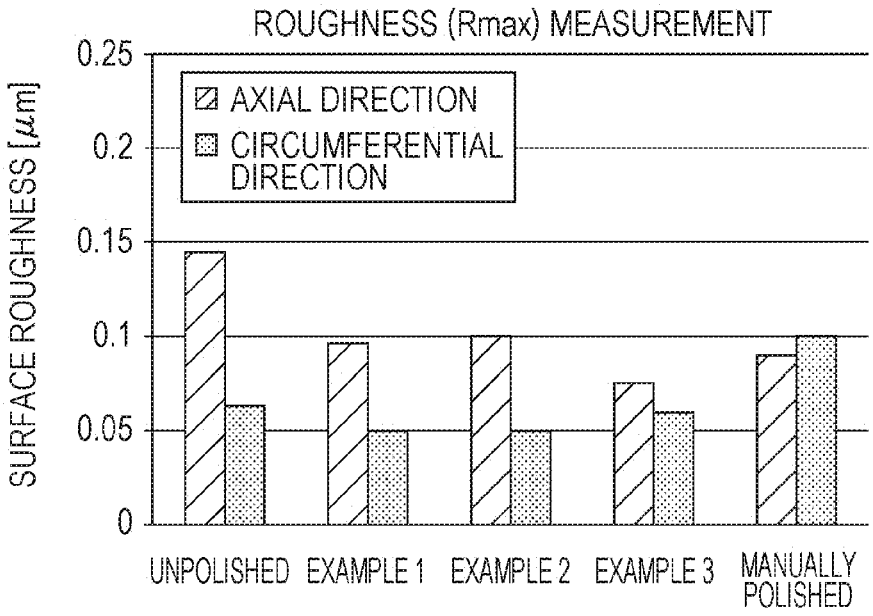
FIG. 16 is a graph depicting the measured surface roughness (Rmax) in FIG. 14 as a bar chart.

FIGS. 11 to 13 show the surface roughness measured in the end regions E3 and E4 of the photoreceptor drums 3 in the axial direction C and the circumferential direction D immediately after polishing by a measurement method in accordance with, for example, JIS (Japanese Industrial Standards) B0601. FIGS. 14 to 16 show the surface roughness measured in the end regions E3 and E4 of the photoreceptor drums 3 after formation of images on 3,000 sheets of A4-size long-edge feed paper by the same measurement method.

The results shown in FIGS. 11 to 13 demonstrate the following points.

The calculated average roughness (Ra) of the surfaces in the end regions E3 and E4 of the unpolished electrophotographic photoreceptor drum (substrate) 30 is less than 0.006 μm both in the axial direction C and in the circumferential direction D. This indicates that the surfaces in the end regions E3 and E4 are nearly specular with extremely small surface roughness.

In Example 1, the calculated average roughness (Ra) of the surfaces in the end regions E3 and E4 of the photoreceptor drum 3 in the circumferential direction D is equivalent to that of the unpolished photoreceptor drum 30, namely, less than 0.006 μm. The calculated average roughness (Ra) of the surfaces in the end regions E3 and E4 of the photoreceptor drum 3 in the axial direction C is more than 0.01 μm, namely, 0.0106 μm. This indicates that the surfaces in the end regions E3 and E4 of the photoreceptor drum 3 are roughened in the axial direction C.

In Example 2, the calculated average roughness (Ra) of the surfaces in the end regions E3 and E4 of the photoreceptor drum 3 in the circumferential direction D is equivalent to that of the unpolished photoreceptor drum 30, namely, less than 0.006 μm. The calculated average roughness (Ra) of the surfaces in the end regions E3 and E4 of the photoreceptor drum 3 in the axial direction C is more than 0.01 μm, namely, 0.0124 μm. This indicates that the surfaces in the end regions E3 and E4 of the photoreceptor drum 3 are roughened in the axial direction C.

In Example 3, the calculated average roughness (Ra) of the surfaces in the end regions E3 and E4 of the photoreceptor drum 3 in the circumferential direction D is equivalent to that of the unpolished photoreceptor drum 30, namely, less than 0.006 μm. The calculated average roughness (Ra) of the surfaces in the end regions E3 and E4 of the photoreceptor drum 3 in the axial direction C is less than but close to 0.01 μm, namely, 0.0077 μm. This indicates that the surfaces in the end regions E3 and E4 of the photoreceptor drum 3 are roughened in the axial direction C.

In the comparative example in which the photoreceptor drum substrate 30 is manually polished, the calculated average roughness (Ra) of the surfaces in the end regions E3 and E4 of the photoreceptor drum 3 in the circumferential direction D is equivalent to that of the unpolished photoreceptor drum 30, namely, less than 0.006 μm. The calculated average roughness (Ra) of the surfaces in the end regions E3 and E4 of the photoreceptor drum 3 in the axial direction C is less than 0.01 μm, namely, 0.0053 μm. This indicates the surfaces in the end regions E3 and E4 of the photoreceptor drum 3 are roughened in the axial direction C, but to a lesser extent.

Next, the results shown in FIGS. 14 to 16 demonstrate the following points.

The calculated average roughness (Ra) of the surfaces in the end regions E3 and E4 of the unpolished electrophotographic photoreceptor drum (substrate) 30 in the axial direction C is 0.0082 μm. The calculated average roughness (Ra) of the surfaces in the end regions E3 and E4 of the unpolished electrophotographic photoreceptor drum 30 in the circumferential direction D is 0.0052 μm. That is, both are higher than those of the initial condition immediately after polishing. This is presumably because the edge of the cleaning blade 8 gradually polishes and roughens the surfaces in the end regions E3 and E4 of the photoreceptor drum 3 as it scrapes off toner remaining after transfer in an image-forming process.

Surface Inspection

Figure 17:
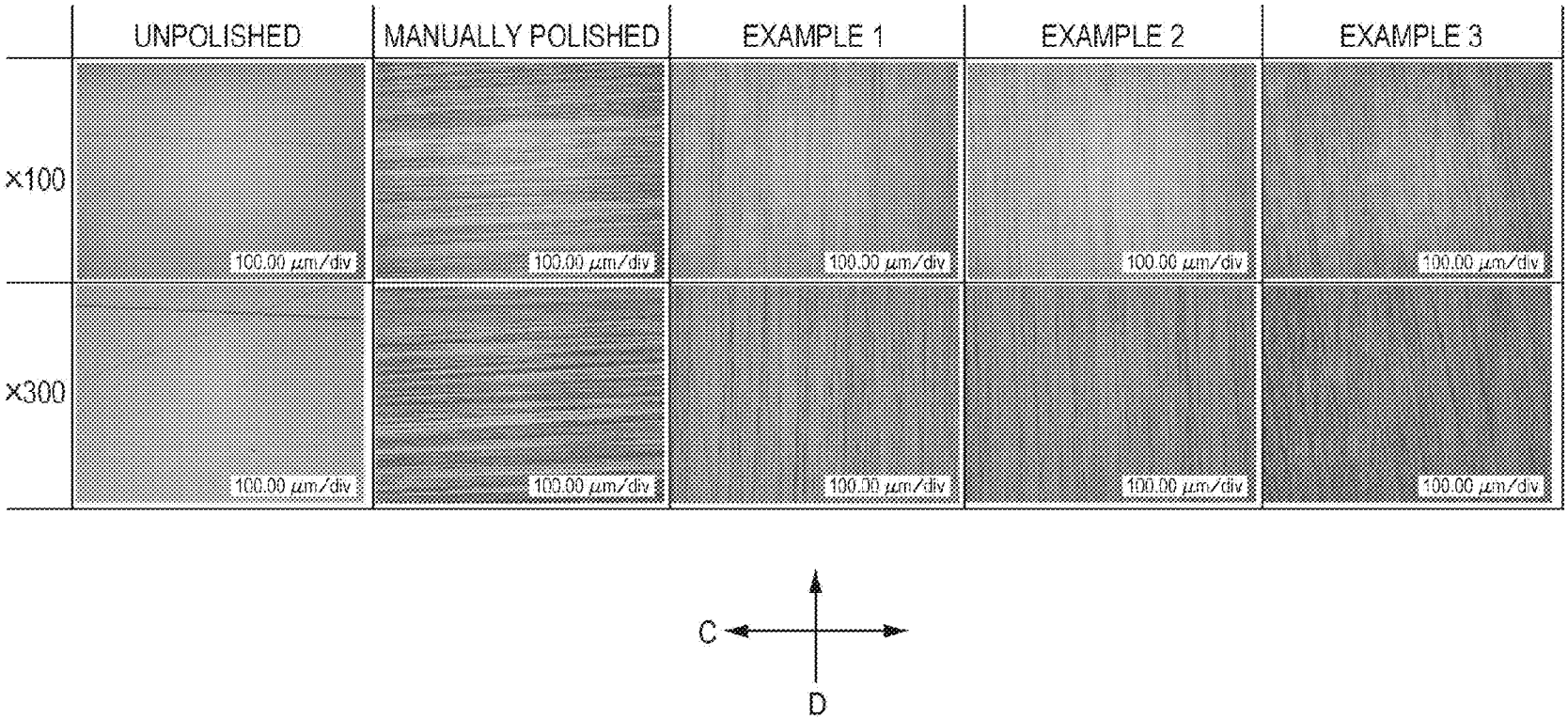
FIG. 17 is a series of micrographs showing the surface condition of the end regions of the electrophotographic photoreceptor drums used in the Examples.

FIG. 17 shows photographs of the surfaces in the end regions E3 and E4 of the photoreceptor drums 3 immediately after polishing in visual inspection under an optical microscope at magnifications of 100× and 300×.

In Example 1, as shown in FIG. 17, the polished surfaces in the end regions E3 and E4 have lines due to polishing formed as thin streaks extending in one direction inclined with respect to the circumferential direction D of the photoreceptor drum 3. In Example 2, the polished surfaces in the end regions E3 and E4 have lines due to polishing formed as thin streaks extending in mutually crossing directions inclined with respect to the circumferential direction D of the photoreceptor drum 3. In Example 3, the polished surfaces in the end regions E3 and E4 have lines due to polishing formed as thin streaks extending in mutually crossing directions inclined with respect to the circumferential direction D of the photoreceptor drum 3. The lines due to polishing formed as thin streaks in Example 3 are inclined at a larger angle with respect to the circumferential direction D than those in Example 2.

Drive Torque of Photoreceptor Drum

Figure 18:
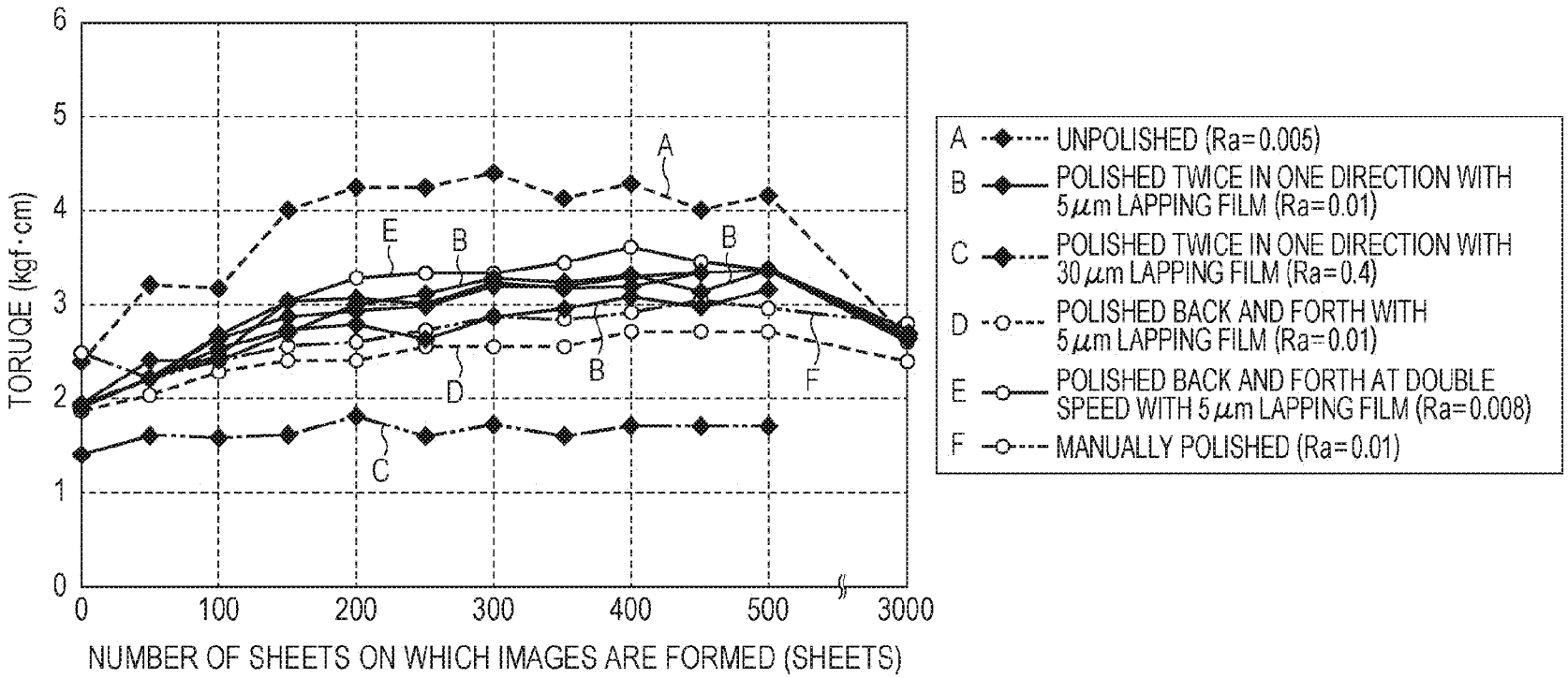
FIG. 18 is a graph showing the measured drive torque of the electrophotographic photoreceptor drums used in the Examples.

FIG. 18 shows the drive torque of photoreceptor drums 3 calculated from the current through the motor used to rotate the photoreceptor drums 3 at a predetermined speed (process speed). The photoreceptor drums 3 used are ones manufactured by polishing the surfaces in the end regions E3 and E4 under different polishing conditions, one manufactured without polishing the surfaces in the end regions E3 and E4, and one manufactured by manually polishing the surfaces in the end regions E3 and E4. The image-forming apparatus used is a bench model in which a cleaning blade 8 abuts the surface of the photoreceptor drum 3 under actual use conditions. This measurement is carried out by rotating the photoreceptor drum 3 without image formation by the amount equivalent to the number of sheets on which images are formed.

As shown in FIG. 18, the unpolished photoreceptor drum 30 has an initial drive torque of about 2.5 kgf·cm. Upon starting of image formation, the drive torque increases to and remains above 4.0 kgf·cm. After images are formed on 3,000 sheets, the drive torque decreases to about 2.6 kgf·cm, although the values therebetween are not shown.

The photoreceptor drums 3 polished under various polishing conditions have low initial drive torques, namely, about 1.5 to 2.5 kgf·cm. Upon starting of image formation, the drive torques remain within the range of about 1.5 to 3.5 kgf·cm. After images are formed on 3,000 sheets, the drive torques decrease to about 2.5 to 2.8 kgf·cm.

As shown in FIG. 18, the photoreceptor drum 3 polished using lapping films having a particle size of 30 μm as the polishing sheets 201 exhibits a remarkably low drive torque, namely, about 1.5 to 1.8 kgf·cm, throughout the measurement. This indicates that the photoreceptor drum 3 has reduced frictional resistance with the cleaning blade 8, demonstrating that the photoreceptor drum 3 is polished in a desired manner.

If the polishing sheets 201 are lapping films having a grain size as large as 30 μm, however, the surfaces in the end regions E3 and E4 of the photoreceptor drum 3 presumably have large ridges and grooves due to polishing and therefore more easily damage the edge of the cleaning blade 8.

In the series of experiments conducted by the inventors, none of the photoreceptor drums 3 of Examples 1 to 3 causes poor cleaning due to wear (damage) to the cleaning blade 8. It is desirable, however, to select the type of polishing sheet 201 for polishing the surfaces in the end regions E3 and E4 of the electrophotographic photoreceptor drum 3 taking into account possible damage to the cleaning blade 8.

As described above, the photoreceptor drums 3 used in the Examples are expected to uniformly wear the edge of the cleaning blade 8 as it contacts the surface of the photoreceptor drum 3 (the polished surfaces in the end regions E3 and E4 and the effective region E2), thus avoiding poor cleaning.

Contamination of Charging Roller

The inventors also conduct an experiment in which images are formed using the photoreceptor drums 3 of the Examples above (including the unpolished and manually polished ones) to visually inspect the surface of the charging roller (roller that is rotated in contact with the surface of the photoreceptor drum 3) of the charging device 4 for contamination. The images are formed using a developer having a small average particle size, namely, 7 μm or less.

After images are formed on 3,000 sheets using the unpolished photoreceptor drum 30, a white deposit of external additive of the toner is found on the surface of the charging roller, particularly in and around the regions corresponding to the end regions E3 and E4 of the photoreceptor drum 30.

In Examples 1 and 2, in contrast, the surface of the charging roller is substantially not contaminated over the length after images are formed on 3,000 sheets.

Electrical Properties and Image Quality

The inventors also conduct an experiment to examine the photoreceptor drums 3 (30) for electrical properties and image quality. The unpolished and polished photoreceptor drums both exhibit good electrical properties. The photoreceptor drums also exhibit high output image quality when images are formed using an image-forming apparatus.

Other Exemplary Embodiments

The layer structure of the photoreceptor drum 3 is not limited to the examples illustrated in the first exemplary embodiment. For example, the photosensitive layer 34 in the coating 32 may be a single layer that functions both as the charge generating layer 341 and as the charge transport layer 342, rather than the function-separated type illustrated in the first exemplary embodiment. In addition, the undercoat layer 33 and the surface protective layer 35 may be omitted from the coating 32.

The process cartridges 20 may include at least the photoreceptor drum 3. For example, the process cartridges 20 may lack the charging roller 4 and the cleaning device 7 or may further include another component such as the developing device 6.

In the first exemplary embodiment, as described above, the image-forming apparatus 1 including the electrophotographic photoreceptor drums 3 is configured as a tandem image-forming apparatus including the image-forming sections 2 (2Y, 2M, 2C, and 2K). The image-forming apparatus 1, however, may be configured as any type of image-forming apparatus that forms an image using at least one electrophotographic photoreceptor drum 3. Examples of other types of image-forming apparatuses include four-cycle image-forming apparatuses that sequentially form toner images of different colors on the surface of a single electrophotographic photoreceptor drum 3 and that transfer the toner images to a recording medium directly or via an intermediate transfer member; and monochrome image-forming apparatuses including a single electrophotographic photoreceptor drum 3. In the first exemplary embodiment, as described above, the intermediate transfer belt 11 is disposed below the image-forming sections 2Y, 2M, 2C, and 2K. The intermediate transfer belt 11, however, may be disposed above the image-forming sections 2Y, 2M, 2C, and 2K.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a substantially cylindrical support extending in an axial direction; and a coating disposed on the support and including a photosensitive layer, an effective region, and an end region outside of the effective region, the end region being adjacent to the effective region in the axial direction, wherein the coating has lines due to polishing extending in a direction crossing a circumferential direction of a surface of the photoreceptor in at least part of the end region and is devoid of polishing portions in the effective region.

2. An electrophotographic photoreceptor unit comprising:

the electrophotographic photoreceptor according to claim 1; and a flat cleaning member that contacts the surface of the photoreceptor, the coating having the lines due to polishing in at least a region contacted by an end of the flat cleaning member.

3. A replaceable image-forming unit comprising the electrophotographic photoreceptor according to claim 1, wherein the replaceable image-forming unit is used by detachably mounting the replaceable image-forming unit in a body of an image-forming apparatus that forms an image using the photoreceptor.

4. An image-forming apparatus comprising:

a rotatable electrophotographic photoreceptor, the photoreceptor being the electrophotographic photoreceptor according to claim 1;

a developing device that supplies a developer to the surface of the photoreceptor; and a flat cleaning member that contacts the effective region and at least part of the end region outside the effective region to remove an undesired deposit therefrom.

* * * * *